US009247368B2

(12) United States Patent
Mango, III et al.

(10) Patent No.: US 9,247,368 B2
(45) Date of Patent: Jan. 26, 2016

(54) LOUDSPEAKER CONE BODY

(75) Inventors: Louis A. Mango, III, Trafalgar, IN (US); Ryszard A. Pilatowski, Palos Hills, IL (US); John F. Steere, Martinsville, IN (US); John S. Stewart, Bloomington, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 2266 days.

(21) Appl. No.: 12/209,482

(22) Filed: Sep. 12, 2008

(65) Prior Publication Data

US 2009/0074228 A1 Mar. 19, 2009

Related U.S. Application Data

(60) Provisional application No. 60/993,583, filed on Sep. 13, 2007.

(51) Int. Cl.
*D21C 5/00* (2006.01)
*H04R 31/00* (2006.01)

(52) U.S. Cl.
CPC ..... *H04R 31/003* (2013.01); *Y10T 29/49005* (2015.01)

(58) Field of Classification Search
None
See application file for complete search history.

(56) References Cited

U.S. PATENT DOCUMENTS 3,149,023 A * 9/1964 Bodendorf et al. ..... 162/135
5,126,012 A 6/1992 Hendren et al.
5,900,029 A 5/1999 Belmont et al.
5,998,309 A * 12/1999 Hesler ..... 442/169
2005/0244644 A1 11/2005 Hampden-Smith et al.
2006/0147081 A1 7/2006 Mango, III et al.
2007/0127760 A1 6/2007 Saiki et al.

FOREIGN PATENT DOCUMENTS

CN 1551934 A 12/2004
EP 0632674 A1 1/1995
EP 1798802 A1 6/2007
JP 2003319490 A2 11/2003
JP 2004-023509 1/2004
WO WO 2007043837 A1 * 4/2007

OTHER PUBLICATIONS

Design, Modulation and Maintenance of Modern Sound box and Loudspeaker, Yinci Jiang, Publishing House of Electronic Industry 1996, pp. 38-47.

* cited by examiner

*Primary Examiner* — Jacob Thomas Minskey
(74) *Attorney, Agent, or Firm* — Brooks Kushman P.C.

(57) ABSTRACT

A loudspeaker cone body made of paper may include a chemically-bound nanomaterial, such as a carbon nanotube. The carbon nanotube may be chemically bound to a functionalizing agent having a chemical group chemically bound to one or more papermaking additives, such as a sizing agent or a wet strength agent, a dry strength agent, a resin or cellulose-containing papermaking stock material typically present in a paper loudspeaker cone body, such as pulp. Acoustic-related loudspeaker performance characteristics such as stiffness to weight ratio and an acoustic damping of the loudspeaker cone body may be altered by incorporation of the nanomaterials chemically bound to the loudspeaker cone body.

18 Claims, 12 Drawing Sheets

(Formation of a Thick Stock)

(First Furnish)

(First Furnish)

(First Furnish)

(First Furnish)

(Formation of a Final Furnish)

(Formation of CNT Modified Paper Pulp During Dry End Work and Preparation of Speaker Cone)

LOUDSPEAKER CONE BODY

PRIORITY CLAIM

This application claims the benefit of priority from U.S. Provisional Application No. 60/993,583, filed Sep. 13, 2007, which is incorporated by reference.

BACKGROUND OF THE INVENTION

1. Technical Field

The present invention relates generally to loudspeaker cones and methods and systems for making loudspeaker cones, and more particularly relates to paper-based loudspeaker cones and methods for making paper-based loudspeaker cones.

2. Related Art

A loudspeaker cone is a well-known part of mid and low frequency loudspeaker designs. A loudspeaker cone body desirably has a sufficient amount of stiffness with minimized weight. This is known as stiffness to weight ratio. A specific modulus, Ys=Ye(Young's Modulus)/specific gravity, is a figure of merit useful to compare and rank alternate materials and compositions. Therefore, loudspeaker cones, and other diaphragms useful for electro-acoustic transducers, are desirably light in weight, high in rigidity (Young's modulus, E), well damped (tan delta), and characterized by a high ratio between the Young's modulus (E) and the density (ρ). Preferred materials for electro-acoustic transducer diaphragms therefore have a high specific modulus (E/ρ) and/or desirably high sound propagation velocity, $v,=\sqrt{(E/\rho)}$.

Although current methods for making loudspeaker cones produce loudspeaker cones with satisfactory specific modulus and/or sound propagation velocity further improvements and enhancements are desirable.

SUMMARY

In one example, a method of forming a loudspeaker cone is provided. The method includes contacting a modified carbon nanotube with a paper-forming stock (e.g. paper-forming compound), such as cellulose paper pulp, and a paper control additive (e.g. paper-treatment compound), such as a retention aid, in a liquid medium such as water. The modified carbon nanotube, the paper-forming stock, and the retention aide may be brought into contact in the liquid medium in a manner such that the modified carbon nanotube is retained onto the paper-forming stock and/or the retention aide forming an adduct. The paper-forming stock, the retaining aide, and other desired papermaking additives may be introduced and combined to form a paper compound. Next, the paper compound may be formed into a loudspeaker cone body. This may be done by removing the liquid medium, heating, drying and reacting the adduct and other additives in the paper compound such that the modified carbon nanotube chemically bonds to the paper compound.

In another aspect, a paper loudspeaker cone is provided that includes a modified CNT material. The cone has the modified carbon nanotube chemically bound to a cellulose-containing compound and/or a paper additive. The paper additives can include a sizing agent, a wet strength additive, a dry strength additive and/or a retention and drainage agent.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DESCRIPTION OF THE PREFERRED EMBODIMENTS

Figure 1A:
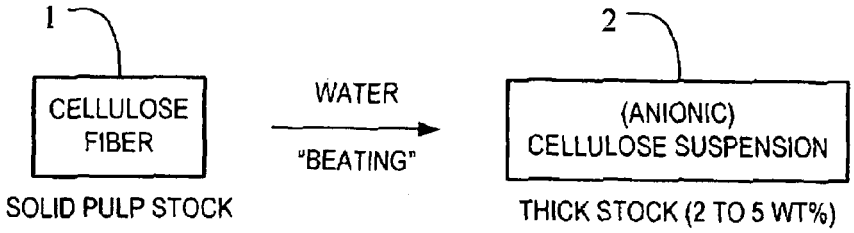
FIG. 1A is a process flow diagram of a method of forming a thick stock for forming a first furnish that is useful in forming a modified CNT-cellulose composition for eventual use in manufacturing a loudspeaker cone.

In at least one example, a loudspeaker cone and a method for making a loudspeaker cone with an improved and/or enhanced specific modulus and/or sound propagation velocity is provided. The method and system incorporate nanomaterials, such as carbon nanotubes, with cellulose-containing pulp materials to form compositions suitable for forming loudspeaker paper cone bodies, as well as loudspeaker cone bodies formed from these compositions. Forming a loudspeaker cone may include chemically binding a carbon nanotube structure to at least one paper-treatment compound and/or cellulose-containing pulp component. In this manner, loudspeaker cones may be formed with nanomaterial structures molecularly bound to one or more components included in, or applied to, a loudspeaker cone. For example, carbon nanotubes may be incorporated within a loudspeaker cone by chemically bonding the carbon nanotubes to one or more paper additives commonly used in paper loudspeaker cones, such as a wet strength agent, a dry strength agent, a sizing agent, or a reactive resin.

The term "nanomaterial," as used herein, includes, but is not limited to, multi-wall carbon (MWCNTs) or single-wall carbon nanotubes (SWCNTs), boron nitride nanotubes, carbon or boron nitride nanoparticles, carbon or boron nitride nanofibers, carbon or boron nitride nanoropes, carbon or boron nitride nanoribbons, carbon or boron nitride nanofibrils, carbon or boron nitride nanoneedles, carbon or boron nitride nanosheets, carbon or boron nitride nanorods, carbon or boron nitride nanohorns, carbon or boron nitride nanocones, carbon or boron nitride nanoscrolls, graphite nanoplatelets, nanodots, other fullerene materials, or a combination thereof Unless otherwise indicated, the term "nanotube" is intended to encompass any type of nanomaterial.

Generally, a "nanotube" is a hollow tubular, strand-like structure. The mean outer diameter of the MWCNTs used in this work (Arkema) is 10 to 15 nm with tube lengths between 0.1 to 10 microns (=10 to 10,000 nm). The mean number of "walls" is from 5 to 15. Single wall tubes (SWCNTs; Wikipedia) may have diameters of about 1 nm with lengths of several thousand nm. Nanotubes may be formed of carbon or other materials.

Unless otherwise indicated, the term "paper-forming compound" as used herein includes cellulose-containing paper-forming or paper-making stock, wood and non-wood based cellulose-containing paper pulp, reactive derivatives of cellulose-containing paper pulp, and other components useful in forming a paper pulp composition (e.g., in a furnish).

Unless otherwise indicated, the term "paper-treatment compound" as used herein refers to both "functional" and "control" additives. "Functional" additives include wet strength agents, dry strength agents, sizing agents, dyes, and other materials that react with papermaking stock to modify one or more properties of a resulting paper-containing compound.

"Control" additives include retention and formation aids, drainage agents, foam control, biocides, corrosion control, and buffers that are used to modify the handling characteristics of the furnish during papermaking. In particular, retention aids may help to fix the CNT to the cellulose surface.

In one example, the loudspeaker cone bodies may include pressed and/or felted paper pulp compositions. The resulting cones are preferably light, stiff and well damped. For cone applications, additional additives may be introduced into a paper pulp composition used for cone manufacturing to enhance the performance attributes of the resulting paper. Such additives may include particulate and fiber reinforcements, and resins and strengthening agents to improve the overall balance of acoustic damping, stiffness to weight ratio, and the alike. Internal and external sizing agents may be used to reduce water adsorption and moisture sensitivity. Drainage and retention agents, and flocculation and coagulation agents, may be used to improve handling of the paper stock during processing, and impart paper stock uniformity for improved paper forming. Dyes may also be added to establish the appearance of the resulting cone material.

Methods for papermaking in accordance with at least one example may be divided into "wet end" and "dry end" processes. Wet end processes may include formation and dilution of stock to the desired consistency, step-wise addition of additives and paper formation by well controlled deposition, filtration, and draining to separate the stock from the excess "white" water. A damp stock is initially formed. The principles of colloid and surface chemistry may be applied in order to accomplish good (desirably >90%) first pass retention. High retention may enhance system economics and help to avoid a variety of downstream process problems.

Dry end processing may include applying heat, e.g., stepwise heating, to the damp stock deposit for further removal of water and/or to initiate curing of any reactive additives. The additives may become chemically bound to the stock, and potentially, other additives. Secondary bonding, e.g., hydrogen bonding, develops as drying occurs and adds to the strength of the paper. Such bonding usually involves the hydroxyl groups of cellulose and other fibers, but may include other suitably constituted additives or particles, e.g., ones that possess polarized or ionized functional groups.

Paper enhancing additives may be incorporated into and retained by the paper stock during "wet end" papermaking operations for effectiveness.

Individual (e.g., relatively small) molecules may be retained with the stock by direct reaction with the pulp cellulose or by secondary chemical bonds, such as for example, hydrogen bonding. Larger aggregates and particles, including emulsions of small molecules, may be entrained in the stock by filtration and/or adsorption phenomena. It is believed that particles whose primary dimensions are approximately 10 microns or less ($10^{-5}$ meter) may be retained by adsorption onto the cellulose fiber surface. In at least one example, modified carbon nanotubes fall mainly within this size range.

Many factors may influence additive adsorption and retention during wet end processing. Cellulose fibers dispersed in water may be anionic above a Ph 3.5 and possess a net negative surface charge. Cationic particles and aggregates have a net positive charge and are thus attracted to neat fiber surfaces to form aggregates that may be better retained in the paper stock. Additional additives called "retention aides" may be used and include aluminum salts and/or certain synthetic polymers described as "poly-electrolytes". These materials function through "patching and bridging" phenomena that adapt the surface charge characteristics (polarity) of materials (fibers, particles, colloidal additives) in the furnish in a manner that makes these components mutually attractive. As a result, additive retention is preferably improved, and more readily filterable agglomerates are formed.

Non-woven reinforcements, e.g., fibers, particulates, etc., may also be included. The beneficial effects of the non-woven reinforcements in finished paper sheet may be influenced by several attributes including intrinsic fiber stiffness, fiber density, aspect ratio, concentration in the matrix, the level of dispersion, and coupling to various matrix binders to provide a means of stress transfer.

Carbon nanotubes (CNTs), an allotrope of carbon, are a type of nanomaterial that has many distinct attributes. These properties include relatively low density (1.35 g/cc), high aspect ratio (order of 1000), high strength (63.5 Gpa), and stiffness (1 Tpa flexural modulus). The small size of these particles (order of 10exp-8 to10exp^−9 meter in diameter) may lead to very high surface to volume and surface to weight ratios and for felted paper cones, the stiffness of CNT containing paper pulp cone bodies may potentially be substantially improved with little or no weight gain. The CNTs include single wall and multiwall varieties referred to hereinafter as SWCNT and MWCNT, respectively. MWCNTs may be relatively more economical than SWCNTs and are commercially available as free flowing black powders.

It is believed that the effectiveness of the CNTs as a paper cone reinforcement is enhanced by increasing both dispersion of the CNTs within the paper matrix and coupling of the CNTs to the cellulose fiber and surrounding matrix. Unfortunately, CNTs in their raw manufactured state are essentially chemically inert and self aggregate in dispersions with various solvents and resins. Accordingly, merely mixing CNT's into a papermaking slurry may not result in the CNT's forming stable dispersions useful in papermaking processes. Moreover, CNTs are hydrophobic making dispersion of the CNTs in the papermaking water slurries impossible without modification to the CNTs. Various synthetic routes have, however, recently emerged which allow a wide array of chemically active functional groups to be introduced onto the CNT particle. For example, one method (Zyvex, Inc—Kentura) introduces functionality onto the CNT particle via a complex organic "wrapper" that partially envelops the nanotube particle. Blends of MWCNTs with various polar polymers such as acrylics have also been used (Arkema Graphistrength technology) to promote dispersion of CNTs into polar media, including water.

Applicants have discovered that the CNT functionality may be selected, possibly in combination with adjusting the papermaking slurry with retention aides and Ph, to be compatible therewith, so as to reduce unwanted self-aggregation of the CNT. This bias facilitates dispersion and retention of the CNT particles onto the pulp and/or paper additives for additional processing to bond the CNT particles to the end product of paper.

In one example, a chemically modified CNT is selected to promote deposition and "wet end" retention of the CNT onto the cellulose fibers present in the furnish. A retention aide may be used if required. The modified CNTs may thus remain within the damp stock and are available to react with other additives in the furnish. Such "curing" reactions may occur in dry end processing as excess water is removed and heat and pressure are applied to the formed stock. In this manner, the retained CNTs may become incorporated and permanently bound into the finished paper cone matrix.

Specifically in at least one example, the process system may include initially forming a water slurry comprised of one or more paper-forming stock materials such as paper pulp and combining one or more papermaking additives with a modified CNT in multiple steps to form a paper furnish composition. At least one of the additives may be a retention aide. The papermaking stock may include wood based cellulose fibers from bleached and un-bleached softwood and hardwood pulps, and non-wood based cellulose fibers such as bast, linen, cotton, cotton linter and others. Paper additives may consist of "functional" and "control" additives. Functional additives may include inorganic and organic fillers and fibers, sizing agents, dyes and brighteners, wet and dry strength aids, and various specialty chemicals added to achieve application specific performance such as resistance to ignition and burning. Control additives may include retention, drainage, and formation aids, biocides, anti-foam and deposit control agents, and specialty chemicals to control such things as Ph, corrosion, and other process conditions. The nanofiller may include a suitably modified and dispersed, or dispersible, carbon nanotube that may be introduced and retained in a wet end process step. The entrained modified CNT may then be chemically reacted, e.g., forming a covalent, ionic or hydrogen bond, with one or more paper making stock materials and/or papermaking additive compounds during dry end processing. Dry end processing may include applying heat to the formed stock on a papermaking machine, or hot pressing and felting the formed stock in a mold to impart a desired geometry, such as a speaker cone body.

In one aspect, fiber stock and additives are prepared for papermaking by initially providing a water based furnish. Stock materials may first be suspended and dispersed in water to provide an initial slurry or thick stock of desired solids content and consistency. In a subsequent step the thick stock may be further diluted with water to provide a thin stock that is eventually deposited on a filtering medium to begin paper formation and eventual dry end work. Various additives may be employed that are introduced to either or both the thin and thick stock, in various combinations and sequences to form the papermaking furnish.

A suitably modified CNT may be introduced into the furnish either prior to, during or subsequent to the addition of any additives. In one example, the modified CNTs may include SWCNTs and MWCNTs with directly or indirectly (e.g. Kentura) attached chemical moieties that have inductive, resonance, or dissociative properties that cause the CNT particles to develop a positive or negative surface characteristic upon being suspended in water to form stable water based dispersions or emulsions. When combined in a papermaking furnish, the modified CNT particles with net positive surface charges may effectively behave as cationic additives, while CNT particles with net negative surfaces may effectively behave as anionic additives. The charged modified CNT particles may act as discrete, individual particles, or alternatively, they may coagulate in varying degrees to form like charged aggregates.

In one example, a wet end papermaking furnish is prepared to retain the modified CNTs that include a functional chemical group that may substantially ionize into anionic or cationic fragments when dispersed in water or any other suitable dispersing fluid. For instance, one fragment of the chemical functional group may remain attached to the CNT as an ion, while the second fragment remains as a solvated "counter ion". The dispersing fluid may be removed, e.g., via heating and/or filtering, where the modified and retained CNTs react with other papermaking additives during dry end processing. Suitable additives may include entities from the furnish that are mobile and remain reactive with the formed stock during dry end processing. Examples may include internal sizing agents, dry strength agents, wet strength agents, and other reactive resins or polymers that may be added to enhance and develop the stock or final paper properties. The modified CNTs preferably chemically bond, e.g., covalent, ionic or hydrogen bonding, during dry end processing to other constituents present in the paper making composition and possibly with one another.

Various reaction sequences (curing reactions) may subsequently occur during dry end processing, post curing, or upon storage following papermaking. The modified CNT can be initially joined to a suitably reactive papermaking additive to form a first adduct. The first adduct may also be formed by reacting the modified CNT with a papermaking additive with the latter previously bound to a fiber, e.g., cellulose, from the paper stock. The first adduct may subsequently react with another reactive additive, a stock fiber, or combination thereof to form the final paper composition. These adducts, including the modified CNTs, may also participate in secondary (hydrogen) bonding, for example, with the hydroxyl content present in stock fibers.

In a second example, a wet end papermaking furnish is prepared with modified CNTs that include an electropositive or electronegative first binding moiety which has electron donating or electron withdrawing properties. Suitably modified positively or negatively biased CNTs or aggregations thereof, may participate in various scenarios to improve their wet end retention prior to dry end processing.

In one aspect, positive (cationic) CNT particles in water furnish may be effectively attracted to and retained by anionically charged cellulose fibers. The cellulose fiber surface is anionic under most papermaking Ph conditions so in this variant some inherent CNT-cellulose attraction and CNT retention may occur. However, the furnish may be additionally serviced with certain polyelectrolytes which may function as aides to improve CNT retention. Successful additives may include high charge density-lower molecular weight polycation "patch" formers used in combination with high molecular weight polyanions. The latter may act as "bridging" agents to promote more stable, longer range inter particle aggregation between CNT particles and the pulp fibers. Flocculation, drainage, and paper formation with high CNT retention is preferably improved.

In a second aspect, negative (anionic) CNT particles may be effectively retained with anionically charged cellulose fibers. The cellulose fiber surfaces are anionic under most papermaking Ph conditions so the CNTs and fibers in this variation will tend to repel one another, thus reducing retention, drainage, and formation for papermaking. To overcome the repulsive forces, the furnish may be serviced with inorganic salts such as alum (aluminum sulfate) and/or with certain polyelectrolytes. In an aqueous media, alum is a source of high molecular weight polycationic aggregates that are capable of coordinating with and "bridging" like charged anionic particles and fibers. Repulsive forces between particles and fibers are reduced and CNT retention to the cellulose fibers may be improved.

Additional effective additives for improving anionic CNT retention onto anionic fiber surfaces may include the high charge density polycationic "patch" formers used in conjunction with high molecular weight polyanions. The former materials may create localized cationic "patches" on the fiber or CNT surface, while the latter may now associate with both particles and act as a "bridging" agent to help aggregate the particles together. Accordingly, improved flocculation, drainage, and paper formation with better CNT retention may be obtained.

Incorporation of Nanomaterials in Paper Materials (General Scheme)

In at least one example and with reference to FIGS. 1*a*-1*e*, fiber stock (e.g. paper-forming compound) and additives (e.g. paper-treatment compounds) are prepared for papermaking by initially preparing a water-based first furnish. As depicted in FIG. 1*a*, fiber stock materials 1 are first suspended and dispersed in water (e.g. via mixing, beating, and/or agitating) to provide an initial slurry 2 or thick stock that may include high solids content, e.g., approximately 2 to 5 percent by weight In one example, the cellulose of the fiber stock includes functional groups, e.g., carboxylic acid groups, which cause the cellulose to have an anionic surface characteristic in the water suspension. However, alternative variation of the paper-forming compound may include fiber stock materials which have cationic surface characteristics in the water suspension.

FIGS. 1*b*-1*e* depict several examples of incorporating suitably modified CNTs into the thick stock 2 to form the first furnish. As discussed earlier, the modified CNTs may include SWCNT and MWCNTs with directly or indirectly (e.g. Kentura) attached chemical moieties that may have inductive, resonance, or dissociative properties that cause the CNT particles to develop a positive or negative surface characteristic upon being suspended in water to form stable water based dispersions or emulsions. When combined in a thick stock 2, the modified CNT particles with net positive surface charges may effectively behave as cationic additives, while modified CNT particles with net negative surfaces may behave as anionic additives. Charged CNT particles may act as discrete, individual particles, or they may coagulate (e.g. to varying degrees) to form like charged aggregates.

Figure 1B:
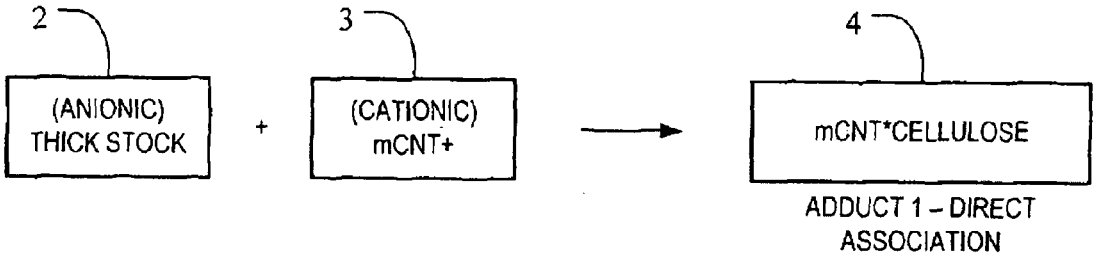
FIG. 1B is a process flow diagram of a first method of forming a first furnish useful in forming a modified CNT-cellulose composition for eventual use in manufacturing a loudspeaker cone.

FIG. 1*b* depicts one example of the modified CNTs forming net positive surface charged particles 3 in the thick stock 2 to form adduct-1 direct association (e.g., electrostatic attraction) to the negative surface charged cellulose. In this scenario, the modified CNTs are retained by the cellulose of the fiber stock, defining mCNT-cellulose component 4 of adduct-1.

Figure 1C:
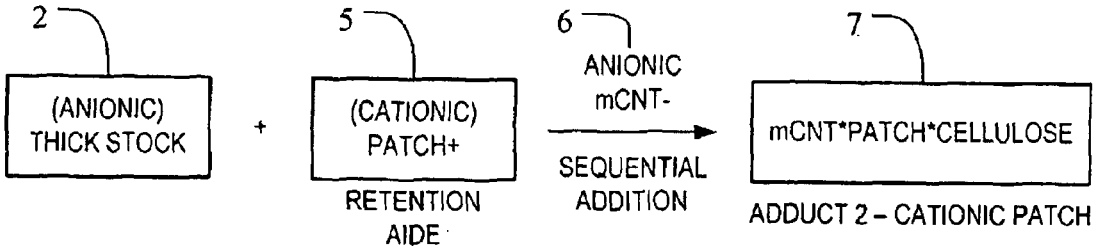
FIG. 1C is a process flow diagram of a second method of forming a first furnish useful in forming a modified CNT-cellulose composition for eventual use in manufacturing a loudspeaker cone.

FIG. 1*c* depicts one example of a retention aide added to and forming net positive surface charged patches 5. The patches 5 may associate (e.g., electrostatic attraction) to the cellulose component of the thick stock 2. The modified CNTs may be subsequently added to the stock 2 forming net negative charged particles 6 which may associate (e.g., electrostatic attraction) to the patches 5 to form adduct-2. In this scenario, the anionic modified CNTs 6 are retained by the cellulose via the patch 5, defining mCNT-patch-cellulose component 7 of adduct-2.

Figure 1D:
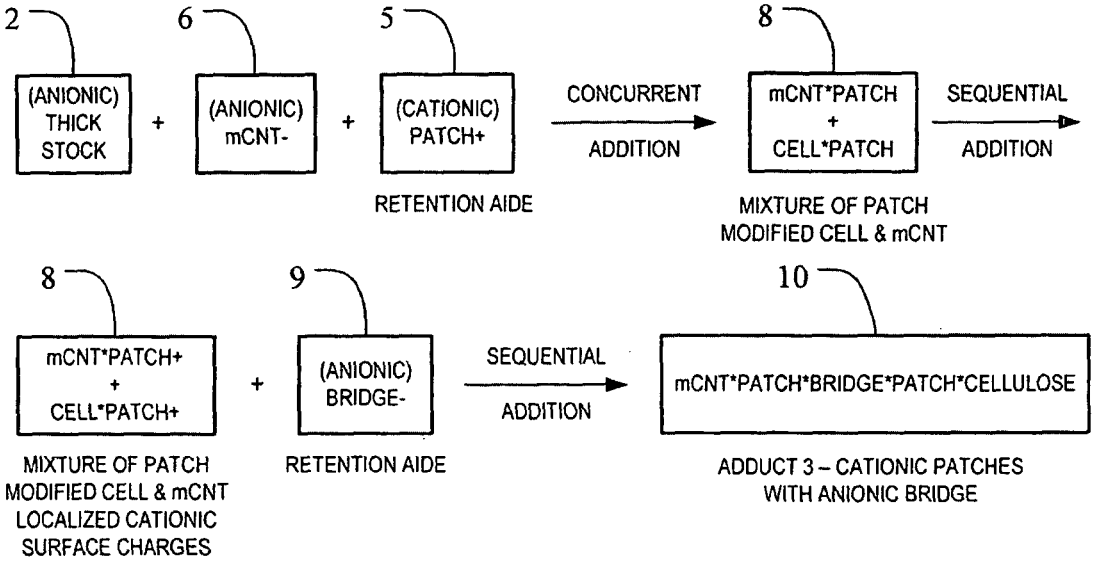
FIG. 1D is a process flow diagram of a third method of forming a first furnish useful in forming a modified CNT-cellulose composition for eventual use in manufacturing a loudspeaker cone.

FIG. 1*d* depicts one example of a retention aide and modified CNTs being concurrently added to the stock 2 to form net negative surface charged particles 6 and net positive surface charged patches 5. In this scenario, at least some of the cationic patches 5 may be associated (e.g., electrostatic attraction) to the anionic particles 6 while other cationic patches 5 may be associated (e.g., electrostatic attraction) to the cellulose to form a mixture 8. Another retention aide may be subsequently added to the mixture 8, forming a negative surface charged bridge 9 which may associate (e.g., electrostatic attraction) to both patched species of the mixture 8, linking them together to form adduct-3. In this scenario, the anionic modified CNTs are retained by the cellulose via a patch-bridge-patch link, defining mCNT-patch-bridge-patch-cellulose component 10 of adduct-3.

Figure 1E:
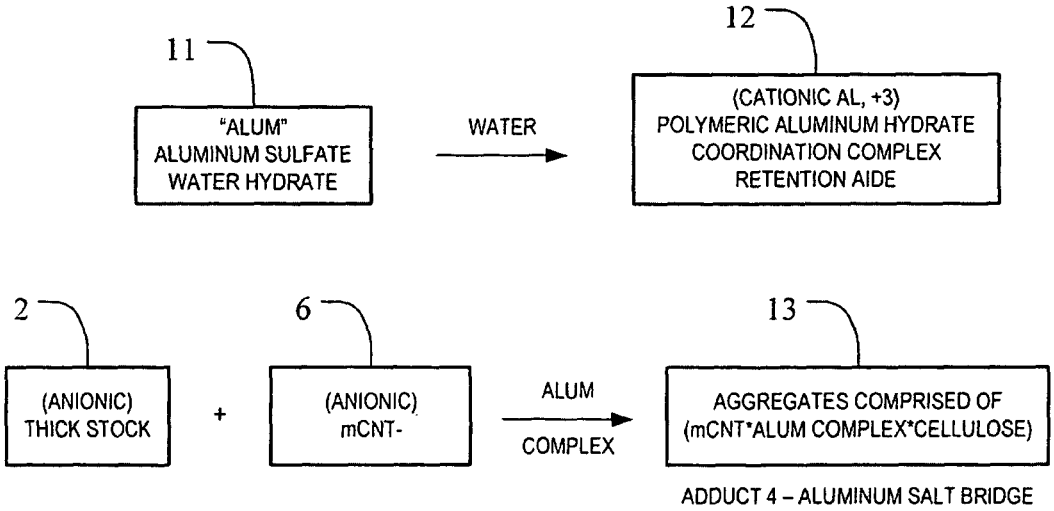
FIG. 1E is a process flow diagram of a forth method of forming a first furnish useful in forming a modified CNT-cellulose composition for eventual use in manufacturing a loudspeaker cone.

FIG. 1*e* depicts one example of the modified CNTs forming net negative surface charged particles 6 in the thick stock 2 containing anionic cellulose fibers. Alum (aluminum sulfate hydrate) 11 forming a cationic coordination complex 12 in water may be blended into the thick stock 2 as a retention aid. The alum complex 12 may act as a salt bridge between the anionic cellulose and the anionic modified CNTs, forming adduct-4. In this scenario, the anionic modified CNTs are retained by the cellulose via the salt bridge, defining mCNT-alum complex-cellulose 13 of adduct-4.

Figure 2:
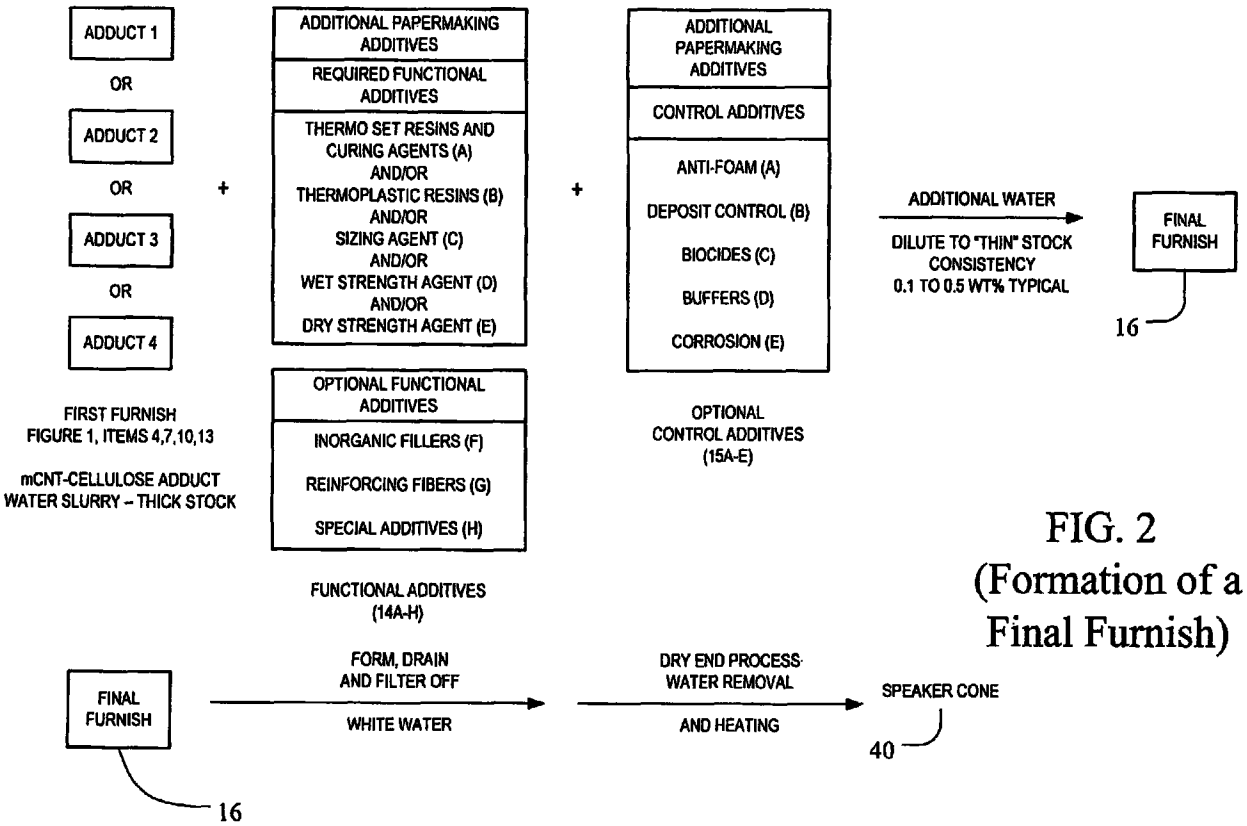
FIG. 2 is a process flow diagram of a method for forming a final furnish composition useful in forming a loudspeaker cone.

Referring to FIG. 2, the first furnish containing one or more of adduct-1, adduct-2, adduct-3 and adduct-4 may be further diluted with water to provide a thin stock, e.g., diluted to approximately 0.1 to 0.5 percent by weigh of solids, that is eventually deposited on a filtering medium to begin paper formation and eventual dry end work for formation of a speaker cone 40. The first furnish may be combined with various paper-treatment compounds or additives introduced into either thick or thin stock in various combinations and sequences to form the final papermaking furnish 16. For example, additives typically required for paper making may be added and can include thermoset resins and curing agents 14*a* and/or thermoplastic resins 14*b* and/or sizing agents 14*c* and/or wet strength agents and/or dry strength agents. Other paper-treatment additives may include control additives for paper making and can include anti-foam additives 15*a* and/or deposit control additives 15*b* and/or biocides 15*c* and/or buffers 15*d* and/or corrosion resistant additives 15*e*. Other optional function additives can include inorganic fillers 14*f* and/or reinforcing fibers 14*g* and/or various other special additives 14*h*.

In one example, the modified and retained CNTs of the wet end furnish contain reactive chemical groups, such as for example, carboxylic acid, amine, and epoxy groups that may react with other additives during dry end processing. Suitable additives may include entities from the final furnish that are sufficiently mobile and remain reactive within the formed stock during dry end processing. Examples may include internal sizing agents, dry strength agents, wet strength agents, and other reactive resins or polymers that may be added to enhance and develop the stock or final paper properties. Examples of compatible reacting groups may include acid anhydride, epoxide, methylol, and hydroxyl groups. In this scenario, the modified CNTs may chemically bond, e.g. covalently bond, during dry end processing to other constituents present in the paper making composition and/or with one another. Various reaction sequences may occur. The modified CNT can be initially joined to a suitably reactive papermaking additive to form a first adduct. The first adduct may also form by reacting the modified CNT with a papermaking additive with the latter previously bound to a fiber from the paper stock. First adducts may subsequently react with another reactive additive, a stock fiber, or combination thereof to form the final paper composition. These adducts, including the modified CNTs, may also participate in secondary (hydrogen) bonding, for example, with the hydroxyl content present in stock fibers.

Processing in accordance with this example may further include substantially removing water or solvents from a final furnish to form a solid filtrate cake containing the modified CNTs. The green stock (solid cake) composition may then be dry end processed by hot pressing in a mold to form a loudspeaker cone 40.

Optionally, a water-reducible thermoset resin emulsion or water-dispersible thermoset resin 14*b* may be introduced directly into the paper making processes as an additive. Examples of suitable thermoset resins may include epoxy, urethane, acrylic, melamine-formaldehyde, urea-formaldehyde and/or phenol formaldehyde resins. The proportions of the resin and modified CNT may be selected to provide a molar excess (or alternatively about molar equivalent) of the thermoset resin. The resin may also be selected to provide functional groups that are reactive with one or more chemical moieties present in the paper furnish.

In one example, the loudspeaker cone includes paper that includes a modified CNTs chemically bound, e.g., covalently bonded, to the paper cone composition. The modified CNTs may each include a binding moiety, which may be an electron donating functional group or alternatively, may be an electron withdrawing functional group. Additional non-binding moieties may also be present to provide desirable inductive and resonance effects. More than one type of binding moiety may also be present. Examples of the binding and non-binding moieties include but may not be limited to a primary, secondary, and tertiary amine, ammonium, amide, hydroxyl, methylol, epoxy, substituted phenols, carboxyl, cyano, nitro, sulfonyl, acyl, isocyanate, and urethane functional groups. The CNT-containing adduct may include a modified carbon CNT chemically bonded, e.g., covalently bound and/or associated by hydrogen bonding, to cellulose or other fibers in the loudspeaker cone, or by a chemical bond to a paper additive compound that is itself chemically bonded, e.g., covalently bound, to the cellulose in the loudspeaker cone. The paper stock may also be chemically modified to covalently bind to the modified CNTs including paper additives, which may have any suitable physical state or chemical structure for incorporation into the paper stock. For example, the paper additive may be a reactive thermoplastic resin, or a water-dispersible thermoset resin or water reducible emulsion containing a reactive thermoset resin including but not limited to an epoxy, phenol-formaldehyde, urethane and acrylic. In one example, the paper additive may be at least one of a thermoset or thermoplastic resin, a sizing agent, a wet strength additive, a dry strength additive and a flocculation, formation and drainage agent.

Figure 3A:
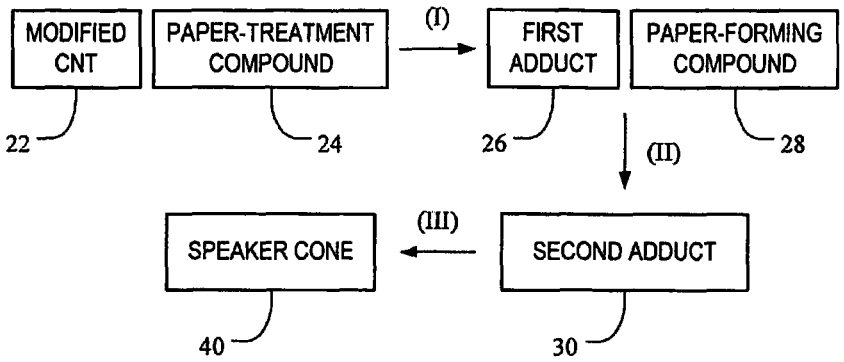
FIGS. 3A-3D are process flow diagrams showing multiple methods for forming a cross-linked paper matrix including cellulose bound, modified carbon nanotubes compounds that may be subsequently formed into a loudspeaker cone.

FIG. 3*a* illustrates an example reaction sequence during dry end processing for making modified paper pulp compositions that are suitable for preparing speaker cones. While illustrated using a modified CNT 22, unless otherwise indicated, the processes may include the substitution of the modified CNT 22 with other nanomaterials.

In a first step (I), a modified CNT 22 that includes a first binding moiety is reacted with an paper-treatment compound 24 (e.g. additive) in a manner effective to bind the modified CNT to the paper-treatment compound 24 to form a first adduct 26. The composition may include a molar excess of chemical binding moieties in the paper-treatment compound 24 over the amount of modified CNT 22. In one example, the first adduct 26 may include unreacted excess chemical binding moieties retained from the paper-treatment compound 24 after binding of the modified CNT 22 to form the first adduct 26.

In a second step (II), the first adduct 26 may be in reactive contact with the paper-forming compound 28 (e.g. cellulose fibers) in a manner effective to form a second adduct 30 including the first adduct 26 chemically bound to the paper-forming compound 28. In a third step (III), the composition containing the second adduct 30 is formed into the speaker cone 40, e.g., hot pressing the green stock composition to form a loudspeaker cone 40. Notable, any of the steps (I-III) may occur during the forming process which may provide heat sufficient to satisfy the activation energy requirements for driving each of the reaction steps.

Figure 3B:
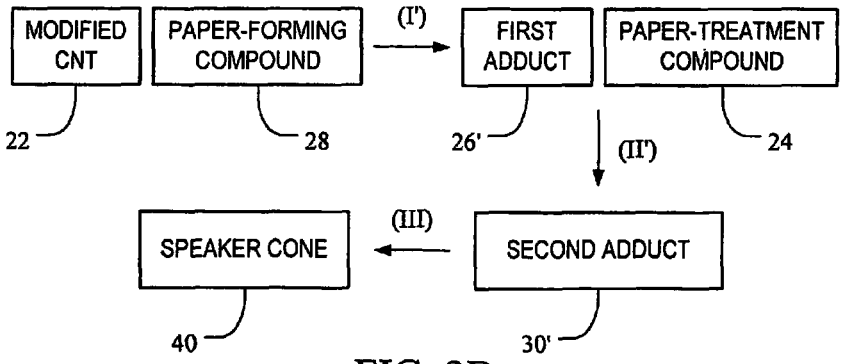

FIG. 3*b* illustrates another example reaction sequence during dry end processing for making modified paper pulp compositions that are suitable for preparing speaker cones. The process is substantially similar to the process illustrated in FIG. 3*a*, except with reaction sequence differences. In a first step (I'), a modified CNT 22 including a first binding moiety is reacted with a paper-forming compound 28 in a manner effective to bind the modified CNT 22 to the paper-forming compound 28 to form a first adduct 26' that includes the modified CNT 22 chemically bound, e.g., covalently, to the paper-forming compound 28. In one example, the first adduct 26' may include unreacted excess chemical binding moieties retained from the paper-forming compound 28 after binding of the modified CNT 22 to form the first adduct 26'. The modified CNT 22 may be formed or provided in a water dispersible resin or a water reducible emulsion of a thermoset resin as discussed previously. The first adduct 26' may be reacted in a second step (II') with a paper-treatment compound 24 to form a second adduct 30'. The second adduct 30' may include, in combination, a modified CNT 22 covalently bound to a paper-forming compound 28 that is, in turn, covalently bound to a paper-treatment compound 24. The second adduct 30' may be formed in a third step (III) into a speaker cone 40. Again, any of the steps (I'-III) may occur during the forming process which may provide heat sufficient to satisfy the activation energy requirements for driving each of the reaction steps.

Figure 3C:
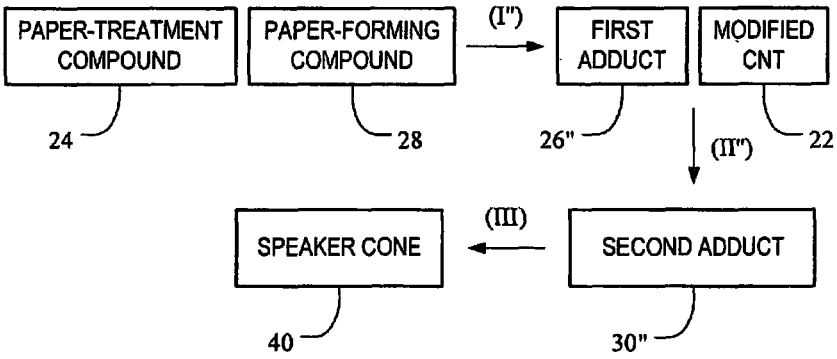

FIG. 3*c* illustrates yet another example reaction sequence during dry end processing for making modified paper pulp compositions that are suitable for preparing speaker cones. The process is substantially similar to the process illustrated in FIG. 3*a*, except with reaction sequence differences. In a first step (I'), a paper-treatment compound 24 is reacted with a paper-forming compound 28 in a manner effective to form a first adduct 26" including the paper-treatment compound 24 bound to the paper-forming compound 28. The first adduct 26" may include one or more chemical groups selected to reactively bind to a modified CNT 22. The first adduct 26" may be reacted in a second step (II") with a modified CNT 22 to form a second adduct 30". The second adduct 30" may include, in combination, a modified CNT 22 covalently bound to a paper-forming compound 28 that is, in turn, covalently bound to a paper-treatment compound 24. The second adduct 30" may be present in the composition formed into a speaker cone 40 in a third step (III).

Figure 3D:
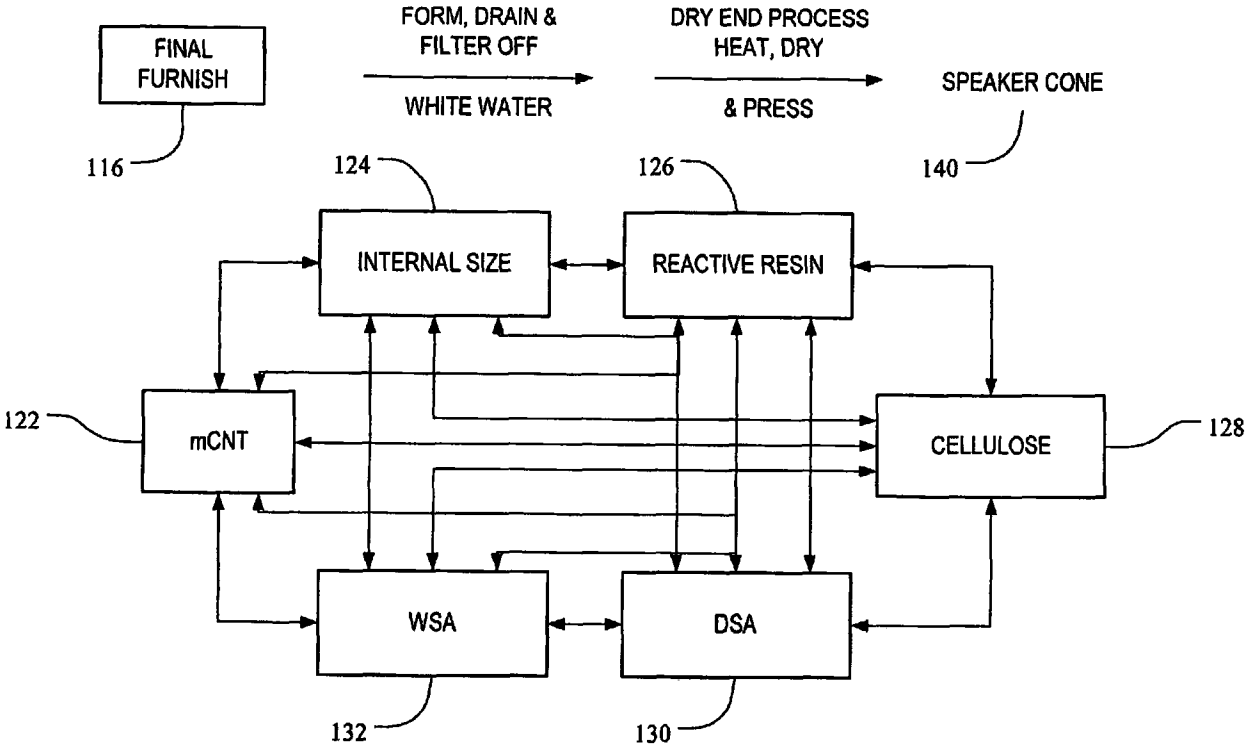

FIG. 3*d* illustrates a plurality of reaction paths during dry end processing that can occur, e.g., from final furnish 116 to formed speaker cone 140. Specifically, the arrows ("←→") indicate the various direct chemical bonding scenarios that can occur to chemically bound, couple and/or adhere the modified CNT 122 to any components 124, 126, 128, 130 and 132 of the speaker cone 140. For example, the modified CNT 122 may be directly chemically bonded to the cellulose 128. Alternatively, the modified CNT 122 may be directly chemically bonded to an internal sizing additive 124, which may be directly chemically bonded to a reactive resin 126, e.g., epoxy resin, which may be directly chemically bonded to the cellulose 128. In yet another example, the modified CNT 122 may be directly chemically bonded to a wet strength additive 132, which may be directly chemically bonded to a dry strength additive 130, which may be directly chemically bonded to a reactive resin 126 which may be directly chemically bonded to the cellulose 128. By forming a chemically bonded 3-dimensional paper matrix with the modified CNTs 122, the resulting paper loudspeaker cone 140 may better utilize the properties specific to the CNTs and have improved and/or enhanced specific modulus and/or sound propagation velocity.

Figure 4A:
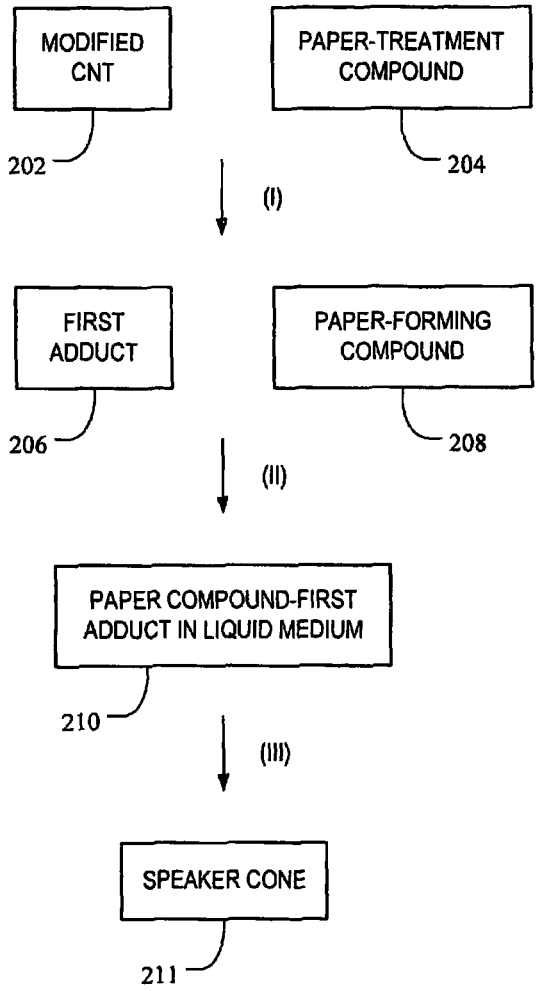
FIG. 4A is a process flow diagram for a first method of forming a composition useful in forming a loudspeaker cone.

FIG. 4*a* is a schematic illustrating an example process for making pressed or felted speaker cones including modified paper pulp compositions. While illustrated using a modified CNT 202, unless otherwise indicated, the processes may include the substitution of the modified CNT 202 with other nanomaterials.

In a first step (I), modified CNT 202 with a first bind moiety may be added with a paper-treatment compound 204, such as a retention aid, into water to form a first adduct 206 (e.g. patch*mCNT).

In a second step (II) a paper forming compound 208 (containing cellulose) made be added into the water to form a cellulose slurry to create a second adduct 210 of the first adduct 206 retained to the paper compound (e.g. cellulose*patch*mCNT). Additional papermaking additives may be optionally introduced to prepare a complete furnish as desired for a particular paper cone application. For example, a sizing agent may be added to improve resistance to water. The second adduct 210 may be a loosely bound aggregation (flocculent) consisting of cellulose stock, mCNTs, and retention aides (e.g. patches) that are held together by relatively weak electrostatic forces as described early. The adduct 210 is however sufficiently stable to substantially survive the shear forces created during drainage and formation, and thus retain the modified CNT with the fresh wet stock.

In a third step (III), the freshly formed stock is further consolidated by progressively filtering off excess water, pressing, and heating the formed paper-mass to produce the speaker cone 211. Additional heating such as by secondary post curing processes, or hot pressing in a mold may also be considered if desired. In any event, reactive moieties present on the various additives, pulp, and modified CNTs may react with one another in a complex variety of curing reactions as depicted in FIG. 3*d* to form the final paper matrix, including chemically bound CNTs. For example, the modified CNT may be covalently bound to the paper compound or alternatively, the chemical bond may be either an ionic bond or hydrogen bonding.

The pH and/or temperature may be adjusted during or between one or more of the steps (I)-(III). This may be performed, for example, to retain stable suspensions of the modified CNT 202, the first and/or second adducts 206, or to react the first binding moiety of the modified CNT 202 and/or the second adduct 210. For example, the modified CNT 202 may be provided with a first binding moiety forming a salt (e.g., $—NH_4^-$ or $—COO^-$) that is water dispersible or water-soluble between a desired pH range. The salt form of the first binding moiety may provide greater water-solubility and/or reactivity of the modified CNT 202 than a corresponding neutral form (e.g., $—NH_3$ or —COOH). A buffering agent, such as sodium bicarbonate, alum, and/or sodium aluminate and others may optionally be added before, between or while performing steps (I)-(II) in order to adjust the pH to a desired range.

Figure 4B:
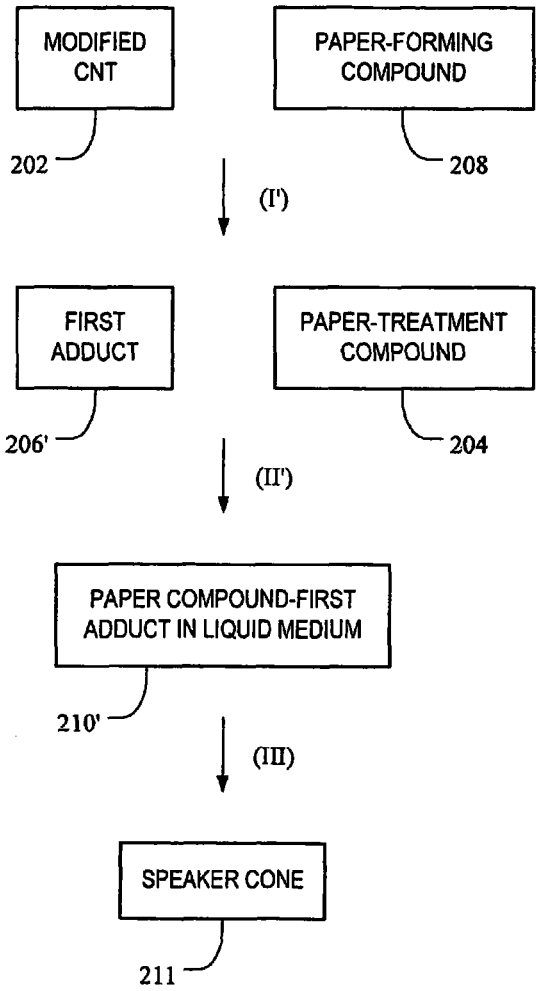
FIG. 4B is a process flow diagram for a second method of forming a composition useful in forming a loudspeaker cone.

FIG. 4*b* is a schematic illustrating another example process for making pressed or felted speaker cones including modified paper pulp compositions. The process is substantially similar to the process illustrated in FIG. 4*a*, except as indicated below. In a first step (I'), the cellulose stock 208 (i.e. paper-forming compound) is made into a water slurry and a water dispersion of a modified CNT 202 that includes a first binding moiety is combined and contacted with the cellulose fiber to create a first adduct 206'. In step (II'), paper treatment compounds, e.g., control additive, retention aids, sizing agents, wet and/or dry strength additives, etc., are added to the mix to form a paper compound-first adduct 210' in the water slurry, which is further processed in step (III) in accordance with step (III) of FIG. 4*a*.

Figure 4C:
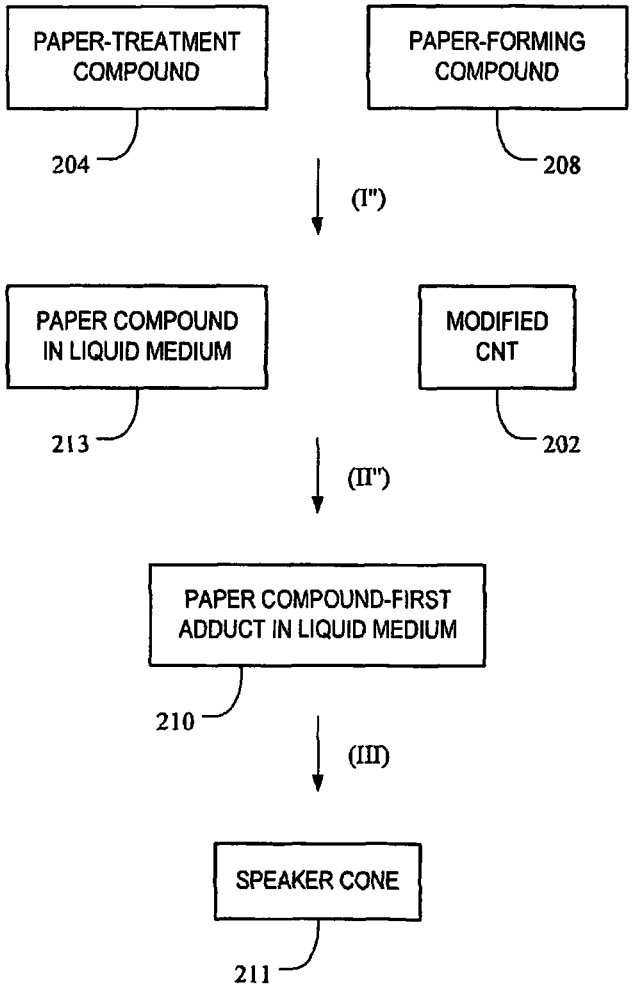
FIG. 4C is a process flow diagram for a third method of forming a composition useful in forming a loudspeaker cone.

FIG. 4*c* is a schematic illustrating another example process for making pressed or felted speaker cones or modified paper pulp compositions. The process is substantially similar to the process illustrated in FIG. 4*a*, except as indicated below. In a first step (I"), the cellulose stock 208 (i.e. paper-forming compound) is made into a water slurry and combined with paper-treatment compounds 204, e.g. retention aids and other additives, to form a paper compound 213. In step (II'), a modified CNT 202 is added to the slurry to form a paper compound with a first adduct 210, which is further processed in step (III) in accordance with step (III) of FIG. 4*a*.

Figure 4D:
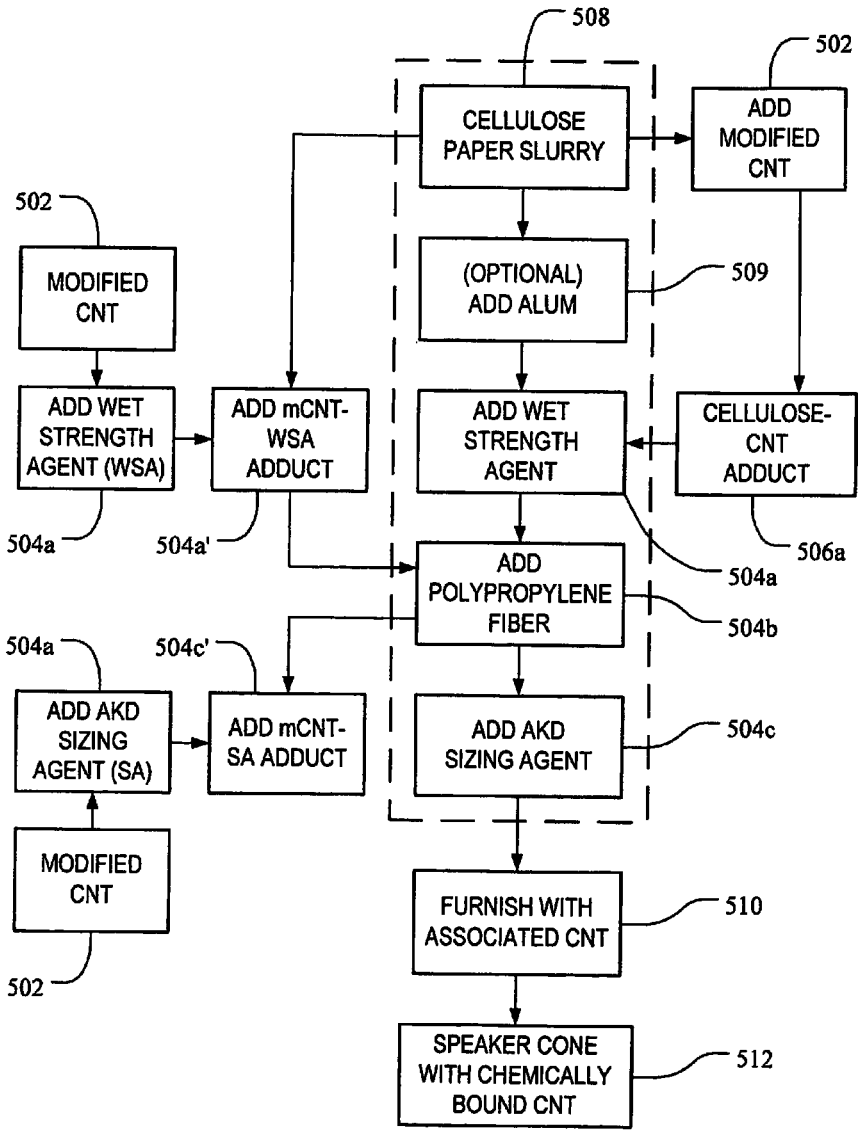
FIG. 4D is a process flow diagram showing multiple methods for forming a paper furnish composition including a cellulose bound modified carbon nanotube compound.

FIG. 4*d* is a schematic illustrating various examples combining one or more processes shown in FIGS. 1*a*-1*c* from above to form a paper-making furnish comprising bound modified CNT molecules. In a comparative example (e.g., Comparative Example 1), enclosed by a dashed line in FIG. 4*d*, a cellulose-containing paper slurry 508 is initially formed comprising a suitable papermaking "thick" stock of approximately 2 to 5 wt % solids dispersed in water. Additional additives may be introduced according to the sequences outlined in FIGS. 4*a*-4*c* to develop the final furnish that is used for papermaking. The furnish mixture is agitated constantly to promote even dispersion of the additives.

Following the sequence, separately constituted mCNTs 502 with a net anionic or cationic surface characteristic may be introduced to the furnish as a stable aqueous dispersion containing approximately 0.5 wt % modified MWCNTs. In a second step, suitable retention aides 509 such as polyelectrolytes or aluminum salts such as alum may be introduced as dilute (e.g. approximately 0.1 to 1.0 wt %) aqueous solutions.

Retention aide(s) are selected for their ability to develop a favorable electrostatic attraction between the mCNT (anionic or cationic surface) and the cellulose fibers (anionic surface). This favorable electrostatic condition is required to promote optimum CNT deposition and retention onto the cellulose fiber surface.

Examples of suitable retention aids include high molecular weight (500,00 to 1 million gms/mole-eqv.) anionic and cationic poly(acrylamide), and high charge density polyamines, such as poly(quatnaryamine) or poly(diallyldimethylammonium chloride) ("DADMAC). Commercial examples may include Hercules Inc. additives PA8137, and D1259/D1274, respectively. These additives may be advantageously used in combination with each other as complimentary "bridge" and "patch" additives. Aluminum salts such as alum may develop complex hydrates in water that may be effective as retention and filtration aides. Other retention systems may include cationic starches used in combination with microparticles such as colloidal silica.

In a third step, a wet strength agent 504*a* may be added to the first suspension. Examples of suitable wet strength agents are described below, and include certain polyamide-epichlorohydrin adducts, such as Kymene 557H from Hercules. In a forth step, a thermoformable polymer may optionally be added. For example, the thermoformable polymer may be a polyolefin or modified polyolefin micro fiber. Other exemplary polymer microfibers may include nylon, polyester, copolyester, rayon and acrylic. A suitable polyolefin may include polyethylene or polypropylene, or a maleic anhydride modified polyolefin. Minifibers Inc, Fybrel 600 is a commercial example of an unmodified polypropylene mini-fiber.

In a fourth step, a sizing agent 504*c* may be added. Sizing, or sizing property, is a measure of the resistance of a manufactured paper or paperboard product to the penetration or wetting by an aqueous liquid. Sizing agents are internal additives employed during papermaking or external additives employed as coating agents during paper finishing that increase this resistance. Papermaking can be carried out under acidic, neutral, or alkaline pH conditions, and the selection of a sizing agent is usually dependent on the pH used. For example, rosin-derived sizing agents are typically used under acidic papermaking conditions. Under alkaline pH conditions, which are widely used in fine paper manufacturing applications, typical sizing agents include alkyl ketene dimers ("AKD") or alkenyl acid anhydrides such as alkenyl succinic anhydrides ("ASA". Commercial alkyl ketene dimmer sizing agents are often prepared from palmitic and/or stearic fatty acids, e.g., Hercon® sizing agents (Hercules Incorporated, Wilmington, Del.). Similar alkyl ketene dimer (AKD) sizing agents may be prepared from branched alkyl ketene dimers. An example of a source of alkyl for a branched ketene dimer is the isostearic group from isostearic acid. Examples of suitable AKD reactive sizing agents are described below, and include Hercon 79. Alternatively, an ASA sizing agent may be used instead of the AKD sizing agent. For example, a Prequel 2000 starch emulsion may be used instead of an AKD sizing agent. The sizing agents, particularly the ASA-Prequel starch system may be sensitive to water, producing a byproduct—a diacid, from the reaction of the anhydride with water—that is no longer reactive and effective. Thus, the sizing agent may be advantageously introduced just prior to filtration and paper forming.

Other additives may be optionally inserted into the above sequence to achieve specific performance or appearance objectives. For example, in the absence of mCNTs—which inherently impart a black appearance to the final paper—a dye such as Keystone Aniline dye JX-AJ-1 may be used to impart a black color to the final paper that is often desired for speaker cones. Dry strength agents may be introduced to enhance the tensile properties of the paper. These materials function by creating additional cellulose fiber-to-fiber hydrogen bonding in dry papers—viz. after water removal. Examples include anionic and cationic starches and poly (acrylamides) which separately acted as retention aides during wet end processing.

In a fifth step, the completed furnish 510 is diluted with water to prepare a think stock of approximately 0.3 wt % consistency. In a sixth step the resulting thin stock is uniformly deposited onto a filtering medium to form and drain the stock. A wet cake composed of the stock and retained additives is obtained. A stainless steel 200 mesh screen and filtering flask may be suitable for small batch preparations. The stainless steel screen may have a desired geometry, such as a flat circular disc or speaker cone shape. Additional pressure or vacuum may be applied in secondary steps to dry the cake to a desired moisture level for subsequent processing. Alternately, the cake may be air dried.

In a final step the collected damp stock may be transferred to a tool and hot pressed to drive off water, and cause any chemically reactive moieties retained in the paper composition to react and cure with one another and the cellulose stock. A final net shape containing CNTs permanently bound into the final paper matrix (i.e. speaker cone with chemically bonded CNT 512) is obtained.

Alternately, the wet cake may be dried at some lesser temperature such as 100 degrees Fahrenheit to dry off residual water and prepare a cellulose fiber prepreg that can be additionally processed and cured at a later time. Additional processing may include the steps of direct application of heat only as required to cure the composition, or an additional intervening step involving infiltration by an additional component, such as a solution or emulsion of a resin or binder.

Modified Carbon Nanotube Additives

The modified carbon nanotube (CNT) may include a cylindrical graphene structure associated with a first binding moiety selected to associate with and/or chemically bind to one or more of the paper additives or paper stock The modified CNT molecules typically have at least one dimension on the order of 1-100 nm ($10^{-9}$ m) and may have a high aspect ratio (for example, greater than about 1,000/1). In general, carbon nanotubes are elongated tubular bodies with a circumference of less than about 100 nm. The carbon nanotubes are hollow and generally have a linear fullerene structure. Single-walled carbon nanotubes (SWNTs) and/or multi-walled carbon nanotubes (MWNTs) may be used. The modified CNT molecules may be chemically functionalized CNT molecules that include a first binding moiety selected to associate with (e.g. via electrostatic charge and/or dipole attraction) and/or chemically bind (e.g. covalent, ionic or hydrogen bonding) to a paper additive or cellulose fiber. Non-limiting examples of suitable first binding moieties include one or more groups selected from the group consisting of: amine, epoxy, hydroxyl, and carboxyl groups.

The modified CNT may be formed by contacting a CNT with a chemical coupling agent, such as a functionalizing agent. The functionalizing agent may include the first binding moiety selected to associate with and/or chemically bind to various functional or control additives and/or paper-stock materials at various stages of wet end and dry end papermaking, or post heating and curing processes. For example, the functionalizing agent may be a poly(aryleneethynylene) (PAE) polymer that binds to CNT structures in the presence of a solvent to form the modified CNT. Furthermore, the functionalizing agent may be selected with a first portion to bind to the nanomaterial, a second portion selected to associate with and/or bind to the paper-treatment compound and/or the paper-forming compound, and provide one or more chemical groups capable of providing a desired water-solubility and dispersibility to the modified carbon nanotube. In particular, the poly(aryleneethynylene) functionalizing agent may include a CNT binding portion configured to bind to the CNT with a desirably high association constant to provide a modified CNT with adequate stability to retain the functionalizing agent bound to the CNT in the presence of the paper pulp composition and in a paper cone body. The poly(aryleneethynylene) functionalizing agent allows CNTs to become dispersed into selected solvents and resins, and may also modify the CNTs to include selected chemically reactive groups. The poly(aryleneethynylene) functionalizing agent may be used to exfoliate, disperse, solubilize, and graft polar, dissociative and/or reactive chemical functions to the CNT and thus prepare modified CNTs for subsequent inclusion as performance modifiers in various paper making formulations. The poly (aryleneethynylene) functionalizing agent may also include a portion having one or more chemical moieties that associate with and/or react with the paper-treatment compound.

The PAE polymer-functionalizing agent may include a backbone of multiple (or "n") monomer units, as illustrated in Example 3. The number of monomer units ("n") may be, for example, from about 5 to about 190. Each monomer unit of the PAE polymer may include at least one electron donating substituent (e.g., $X_1R_1$ and $X_2R_2$ in Example 3) and/or at least one electron withdrawing substituent (e.g., $Y_1R_3$ and $Y_2R_4$ in Example 3). The term "electron withdrawing," as used herein, refers to an atom or group of atoms in a covalent bond with a second atom and having a greater tendency to attract shared electrons from the second atom. The term "electron donating," as used herein refers to a first atom or group of atoms joined in a covalent bond to a second atom and having a tendency to release shared electrons to the second atom. Each monomer portion may include at least one electron donating substituent or at least one electron withdrawing substituent, at least one of the electron donating substituent and the electron withdrawing substituent may be bound to an alkyl, phenyl, benzyl, aryl, allyl or H group, and each alkyl, phenyl, benzyl, aryl, or allyl group may be further bound to a first binding moiety (e.g., groups $Z_1$-$Z_4$ as shown in Example 3). A PAE polymer may include multiple electron donating substituents and multiple electron withdrawing substituents, and the PAE polymer may be electrostatically anisotropic along the length of the polymer. The poly(aryleneethynylene) may have other than a 1:1 ratio of monomer units containing the electron donor to monomer units containing an electron acceptor substituents, such as a molar ratio of electron donor to electron acceptor monomer units of 3:1, 7:1, 1:3, or 1:7. In addition, a portion of the PAE polymer may also be adapted to associate with and/or covalently bind to a paper-forming compound and/or a paper-treatment compound, for example by containing additional epoxide, hydroxyl, anhydride, phenol, amine, or carboxylic acid moieties.

In particular, the modified carbon nanotube may be provided in combination with (e.g., non-covalently bound to) a functionalized poly(aryleneethynylene) (PAE) polymer functionalizing agent, such as a functionalized poly(phenyleneethynylene) described in Example 3. The "arylene" group of "poly(aryleneethynylene)," as used herein, may include phenyl, diphenyl, naphthyl, anthracenyl, phenanthrenyl, pyridinyl, bis-pyridinyl, phenanthrolyl, pyrimidinyl, bis-pyrimidinyl, pyrazinyl, bis-pyrazinyl, aza-anthracenyl, or isomers thereof. The PAE polymers may be rigid functional conjugated polymers based on a poly(phenyleneethynylene) structure. Studies of PAE polymer structures include: Bunz, U. H. F. Chem. Rev. 2000, 100, 1605-1644 and McQuade, D. T. et al., J. Am. Chem. Soc. 2000, 122, 12389-12390. Examples of poly(aryleneethynylene) functionalizing agents that can be contacted with a CNT to form a modified CNT are described in published US patent application no. 2006/0054866 A1, filed Apr. 13, 2005. One example of a vendor of poly(aryleneethynylene) functionalizing agents are the products sold under the tradename "Kentura" technology by Zyvex, Inc.

The nanomaterial and polymer may be combined in a solvent to form a dispersion containing the modified carbon nanotube. For example, the dispersion may be stable flowable water dispersions of a 0.01-0.8% wt. (e.g., a 0.5% wt) stable flowable dispersion of a modified CNT in water. This dispersion may be added to a water suspension containing paper-forming compounds 8 and/or paper-treatment compounds. Nanomaterial such as the modified carbon nanotube, may be formed by mixing a solid powder nanomaterial (e.g., SWCNT or MWCNT) and a functionalized poly(aryleneethynylene) polymer, such as a poly(phenyleneethynylene). A PAE polymer with monomer units having at least one electron donating substituent or electron withdrawing substituent may be mixed with the nanomaterials in a solvent, such as water, chloroform, dichlorobenzene, or another halogenated and nonhalogenated organic solvent. The PAE polymer may associate with the nanomaterials to form the modified CNT in the solvent. A first portion of the PAE polymer may be adapted to non-covalently bind to a carbon nanotube, while a second portion of the PAE polymer may be adapted to impart water solubility to the CNT-bound PAE polymer adduct. A PAE polymer portion may associate with a nanomaterial (e.g., via pi-electron interaction with a carbon nanotube) to form the modified carbon nanotube. Optionally, the nanomaterial may be pre-sonicated prior to combination with the PAE polymer. The modified CNT may be subsequently removed from the dispersion or solution by removing dispersion/solubilization solvent and forming a solid (e.g., solid exfoliated nanomaterial). The modified CNT may optionally be re-dispersed or re-solubilized by mixing solid exfoliated nanomaterial with a re-dispersion or re-solubilization solvent prior to addition to a paper pulp or combination with a paper-forming compound or paper-treatment compound.

Alternately, the modified CNT may be provided without a functionalizing agent. Various other chemical methods may be used to add reactive chemical groups to CNTs to form the modified CNT, and subsequently disperse these into solvent or resin media through various techniques such as ultra-sonication and precision roll milling. The modified CNT may be chosen to contain "active hydrogen" bearing functional groups that may in turn be used to beneficially associate and/or bind the modified CNTs into a paper pulp matrix including one or more reactive (e.g. sizing and wet strength) additives as part of a paper making composition. For example, the modified CNT may be formed by contacting a CNT with one or more molecules containing at least one reactive chemical group selected to form a covalent bond with the paper-treatment compound.

The modified CNT may include a first binding moiety selected to associate with a retention aide and/or chemically bind to a papermaking additive. For example, a modified CNT with a pendant amine first binding moiety may be prepared according to a 1,3cycloaddition reaction, such as reaction scheme (1). The resulting pendant amine-modified CNT may readily associate with and/or bind to an acid anhydride, epoxide or glycidyl ether group that may be present in a paper-treatment compound or paper-forming compound.

(Scheme 1)

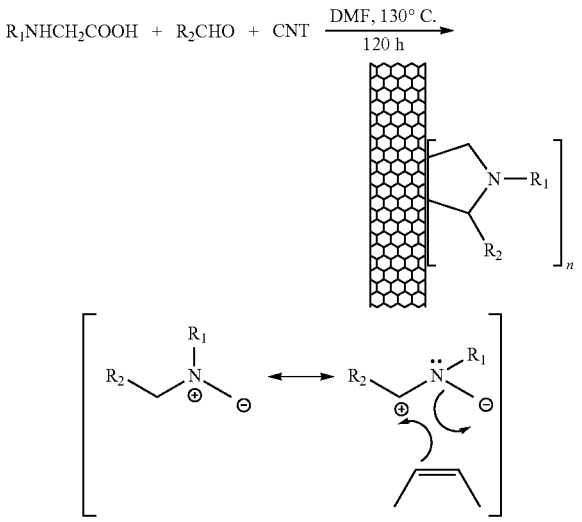

In reaction scheme (1), (n) is an integer referring to the molar ratio of amine moieties bound to the carbon nanotube, CNT is a carbon nanotube structure, and the $R_1$ and $R_2$ groups may be chosen to provide a desired first binding moiety, where $R_1$ and $R_2$ are independently chosen from hydrogen, alkyl groups, ether groups, carboxylic acid groups, and aryl groups. For example, $R_1$ may be hydrogen or an ethylene oxide polymer chain such as —$[(CH_2)_2O—]_3$—$CH_3$ or 1,6-dihydropyrene and $R_2$ may be —H or benzaldehyde. Preferably, at least one of $R_1$ and $R_2$ includes a first binding moiety, or are hydrogen. In another example, $R_1$ may be an ethylene oxide polymer chain such as —$(CH_2)_6$—$CH_3$ and $R_2$ may be —H. The 1,3-dipolar cycloaddition of azomethine ylides may be generated in-situ by thermal condensation of aldehydes and ¤-amino acids gives rise to soluble modified CNT materials (see, e.g., V. Georgakilas, K. Kordatos, M. Prato, D. M. Guldi, M. Holzinger and A. Hirsch, J. Am. Chem. Soc., 2002, 124, 760; and V. Georgakilas, N. Tagmatarchis, D. Pantarotto, A. Bianco, J.-P. Briand and M. Prato, Chem. Commun., 2002, 3050, both of which are incorporated herein by reference in their entirety). Without being bound by theory, azomethine ylides are believed to be very reactive with the pi-system of the CNT, both at the tips and the sidewalls of the CNT. In this manner, a large number of pyrrolidine rings may be fused to the carbon—carbon bonds of CNTs to form the mCNT structures. About one pyrrolidine moiety may be introduced per one hundred carbon atoms in the CNT network. Forming modified CNT ("mCNT") structures with a high number of the first binding moiety may render the mCNT more soluble in water. A N-functionalized glycine, bearing a protected amino end group, may be used to generate the corresponding mCNT, which after acidic treatment may lead to the formation of an ammonium salt. The presence of these polar functionalities may provide the mCNT with a very high solubility in water. Using a 1,3cycloaddition reaction, a variety of different first binding moieties may be covalently bonded to the CNT to form mCNT molecules such as the mCNT molecules shown in Formulae (I), (II), (III) and (IV):

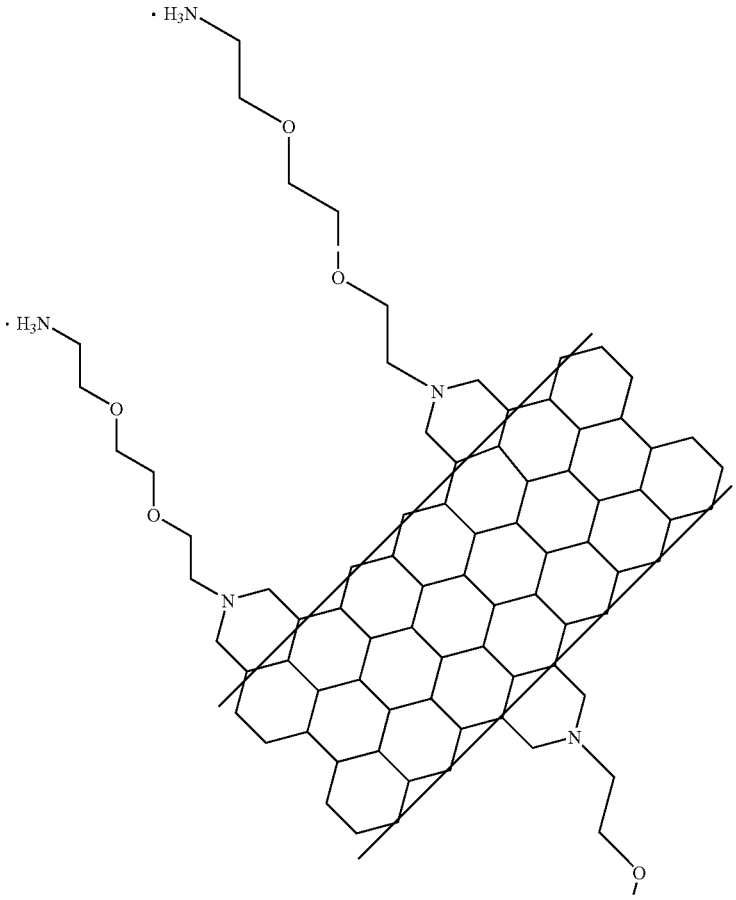

(I)

-continued
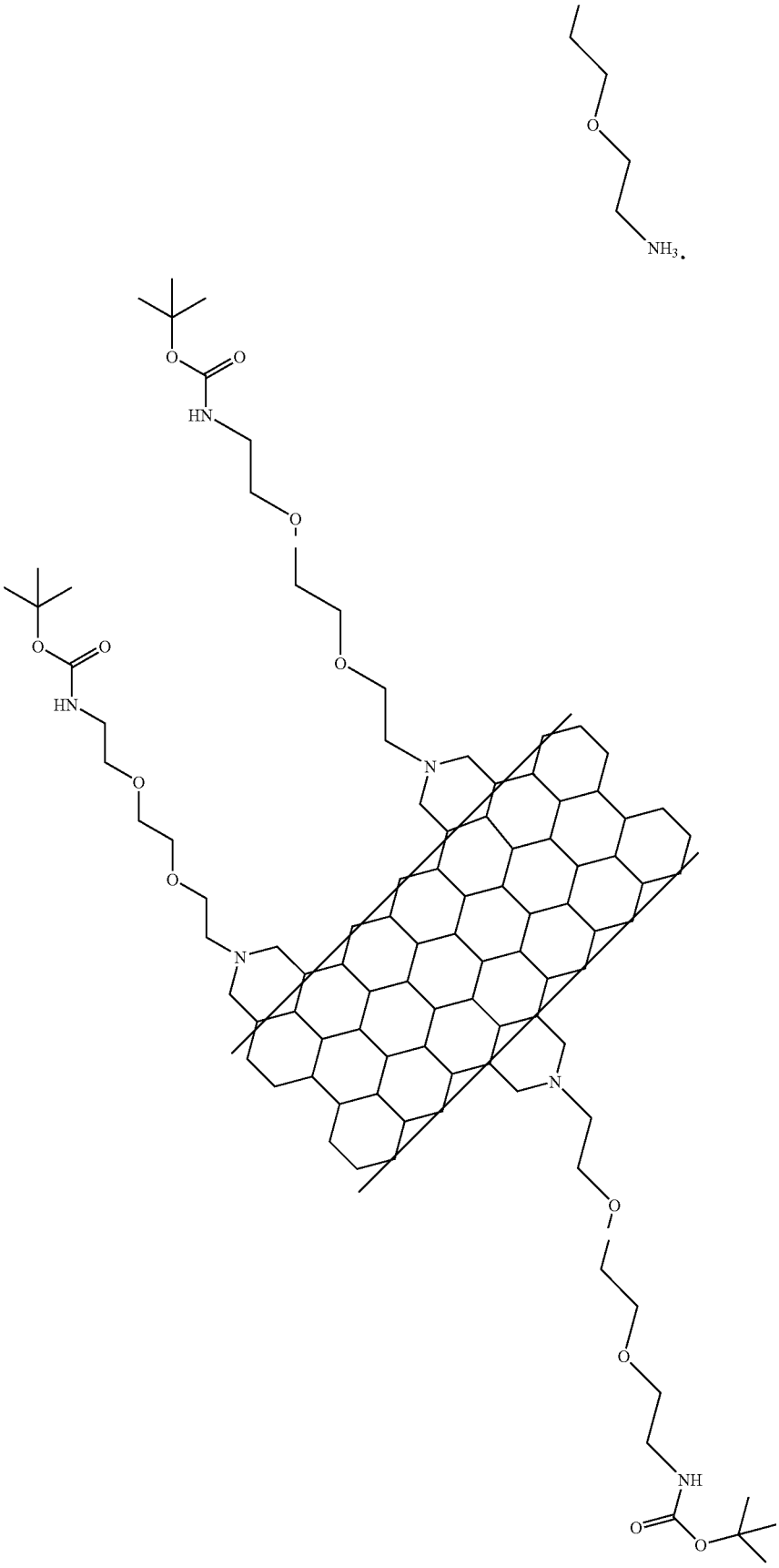
(II)

-continued
(III)
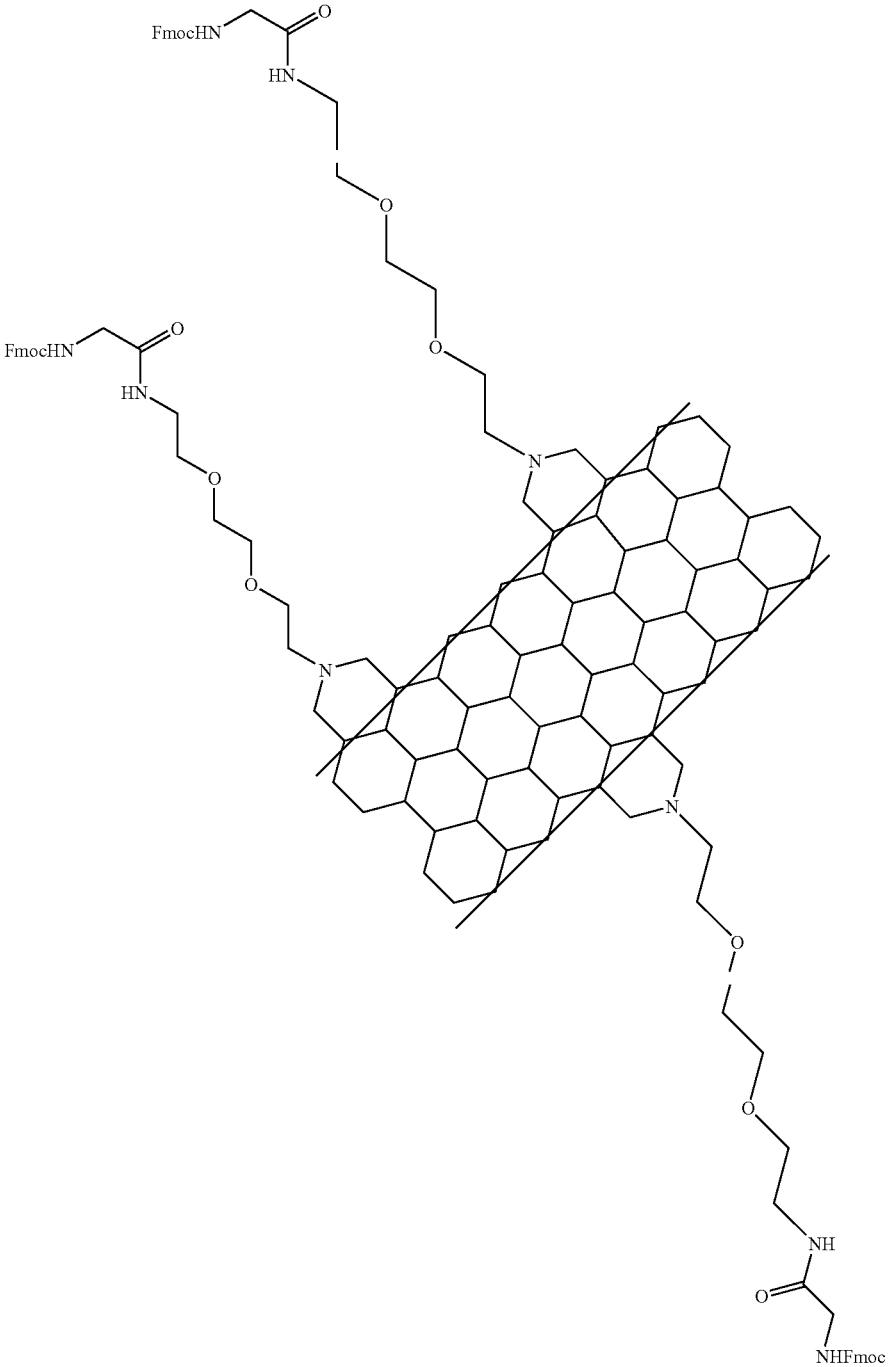
(IV)
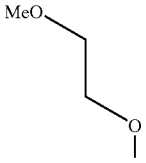

-continued

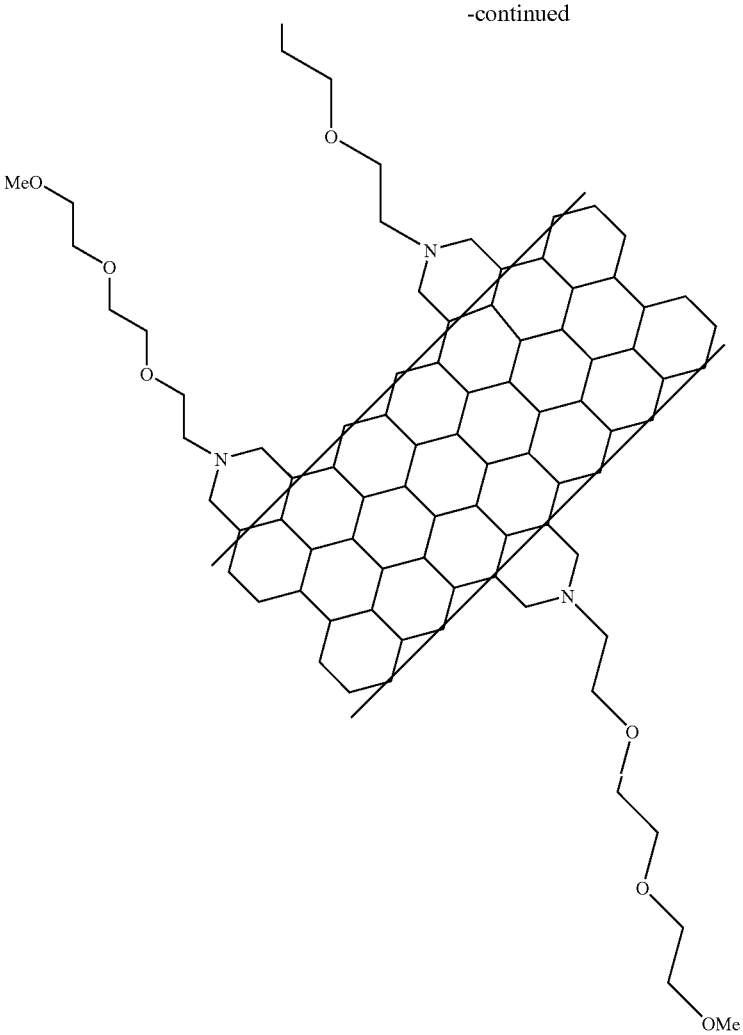

The mCNT molecules may also include additional binding moieties besides the first binding moiety. For example, the mCNT molecule may have a first binding moiety adapted to bind to a cellulose agent, a sizing agent or a wet strength agent, and a second binding moiety adapted to increase the solubility of the mCNT molecule. For example, the second binding moiety may be a N-substituted glycine, characterized by the presence of solubilizing chains, such as oligo ethylene glycol moieties. Optionally, the second binding moiety can be selected to be thermally in a heat treatment step or chemically removed in a step that alters the pH, thereby changing the water solubility of the mCNT.

In another example, modified CNTs include other first binding moieties, such as carbodylic acids. A modified CNT with a pendant amine first binding moiety may be prepared by treating carbon nanotubes with lithium metal and gaseous ammonia to form carbon nanotube salts. These salts may undergo polymerization in the presence of a monomer such as methyl methacrylate or other alkenes or alkynes. Carboxylic acid moieties may be formed pendant to the carbon nanotube structures by adding a suitable monomer, such as methyl methacrylate (MMA) monomer, under conditions permitting anionic polymerization, as shown in reaction scheme (2).

(Scheme 2)

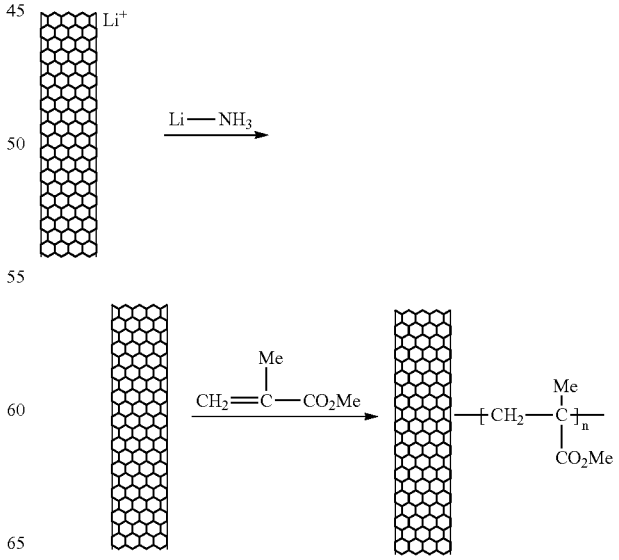

Alternatively, single wall CNT compounds may be functionalized with carboxylic acid binding moieties by treatment with sulfuric acid and nitric acid, as shown in reaction scheme (3).

(Scheme 3)

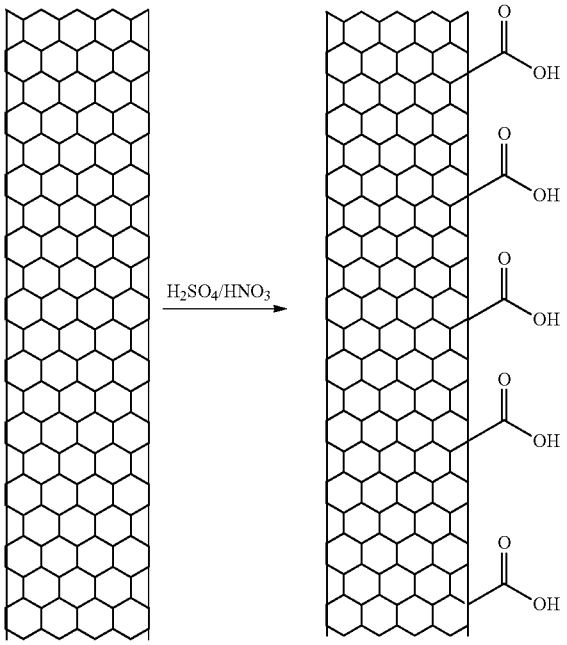

In another example illustrated in FIG. 1A, a modified CNT may include chemical groups such as anhydride, carboxyl NCO or cyclic lactone moieties (e.g., Z groups in Example 1) selected to associate and/or react with hydroxyl groups on cellulose in a paper-forming compound. The modified CNT may be combined in an aqueous or organic solvent media with the cellulose-containing paper-forming compound to form the first adduct, which may be reacted with a paper-treatment compound (e.g., a sizing agent such as an alkenyl succinic anhydride) during the forming of the speaker cone. Another example of a paper-treatment compound is an alkyl ketene dimmer (AKD) internal sizing agent associated with the modified CNT to form the first adduct, preferably without alum present in the pulp composition and at a pH of between about 6 and 8. In another example, the paper-treatment compound (e.g., a reactive sizing agent having an ASA moiety) may be initially bound to hydroxyl groups on cellulose of a paper-forming compound which may be subsequently associated with the modified CNT to form the composition suspension-first adduct.

Paper-Treatment Compounds

The papermaking additives may be any one or more compound suitable for incorporation with a cellulose-containing paper-forming compound to form a loudspeaker cone. The papermaking additives may perform one or more different functions within a paper-making composition, and may be selected to include a chemical group capable of forming a chemical bond and/or becoming associated with the first binding moiety of the modified carbon nanotube. For example, the paper-treatment compound may be selected from compounds that function as a sizing agent, a wet strength agent, a dry strength agent, a drainage agent, a retention and flocculation agent, an antistatic agent and/or a coating agent that may be employed in paper-making compositions. In one example, the paper-treatment compound may be selected to be combined with hydroxyl or hydroxymethyl chemical groups present in the cellulose fiber portion of a paper-forming compound.

In one example, the papermaking additive compound may be a reactive wet strength additive (WSA). The papermaking additive compound may be formed by the reaction of a polyethyleneimine such as diethylenetriamine (DETA, formula (VII) below) with a dibasic carboxylic acid such as adipic acid to form an intermediate polyamide adduct.

(VII)

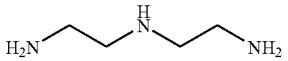

The resulting polyamide adduct intermediate may be reacted with epichlorohydrin to produce an adduct (e.g., as described in Example 5 below) having an epoxide group that may combine with a first binding moiety in a modified CNT or with hydroxyl groups in a cellulose portion of a paper-forming compound. A commercially available version of a suitable WSA paper-treatment compound is Kymene 557 from Hercules, Inc. The wet strength additive may be provided at a pH of about 5-6. Kymene is the tradename for certain wet strength agents available from Hercules Incorporated, including Kymene 557H, Kymene 450, and Kymene 2064 (an APE resin based on methyldiallylamine monomer that is polymerized to an amine polymer precursor), as well as low absorbable organic halide (AOX) versions such as Kymene 557LX.

The wet strength agent may include or be formed by reacting compounds with an epichlorohydrin moiety. For example, Kymene 557H is formed by reacting adipic acid with diethylenetriamine (DETA) to form a poly(aminoamide) that is alkylated and crosslinked with epichlorohydrin to form a PAE resin, namely, adipic acid-DETA poly(aminoamide) epichlorohydrin. To form other wet strength additives, a TETA or DETA polyamine may be reacted with a dibasic acid to provide a polyamide intermediate that may be reacted with epichlorohydrin to form the wet strength agent. The wet strength agent can be combined with alcohol moieties such as the primary alcohol moieties R—OH pendant to cellulose in formula (VII) below according to scheme (5). The epoxide moiety can be reacted with hydroxyl groups on cellulose in wood pulp under basic or acidic conditions to produce pulp-hydroxy ethers. For example, Scheme 5 illustrates the reaction of an alcohol with epichlorohydrin. In Scheme 5, the R group is preferably a portion of a cellulose molecule; R—OH may be the primary alcohol group pendant to the cellulose molecule. The wet strength additive may also include a polyamide moiety bound to the epichlorohydrin, such as diethylenetriamine (DETA) having the formula (VII) above.

In another example, the paper-treatment compound may be a reactive internal sizing agent such as an alkenyl succinic anhydride (ASA) that is reacted (e.g. in the speaker cone forming step) to the binding moiety of the modified CNT or to cellulose in a papermaking stock compound (such as a compound of formula (V) below). For example, the ASA (e.g., formula (V)(c) below) may be made by reacting an olefin (e.g., formula (V)(a)) with a maleic anhydride (e.g., formula (v)(b)), for example as shown in Scheme 4 below.

(Scheme 4)

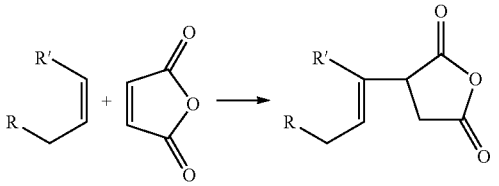

The R and R' moieties may be long chain alkyl chains to provide hydrophobic properties. Examples of such ASA structures include branched and linear 2-alkenyl succinic anhydrides such as dodecenyl succinic anhydride; octenyl succinic anhydride, n-tetradecenyl succinic anhydride; and nonenyl succinic anhydride. The sizing agent may be provided at a pH of about 5-6.

For example, an ASA papermaking additive of formula (V)(c), or a derivative thereof, may be used as the paper-treatment compound. The ASA internal sizing agent may be provided with or without alum, although the alum (when present) is typically added separately. Preferably, a compound of formula (V)(c) is brought into contact with a modified CNT to associate the modified CNT to the paper-treatment compound, forming a first adduct which may be subsequently reacted during the speaker cone forming step. For example, the mCNT of formula (I) may be combined with the paper-treatment compound of formula (V)(c) to form an adduct with formula (VI). The ASA internal sizing agent may be provided in a starch emulsion at a pH of between about 6 and 8 may be contacted with the modified CNT. One preferred ASA compound is sold under the tradename Prequel 2000C. A starch emulsion suitable to use with the ASA compound is sold under the tradename Prequel 500.

(VI)

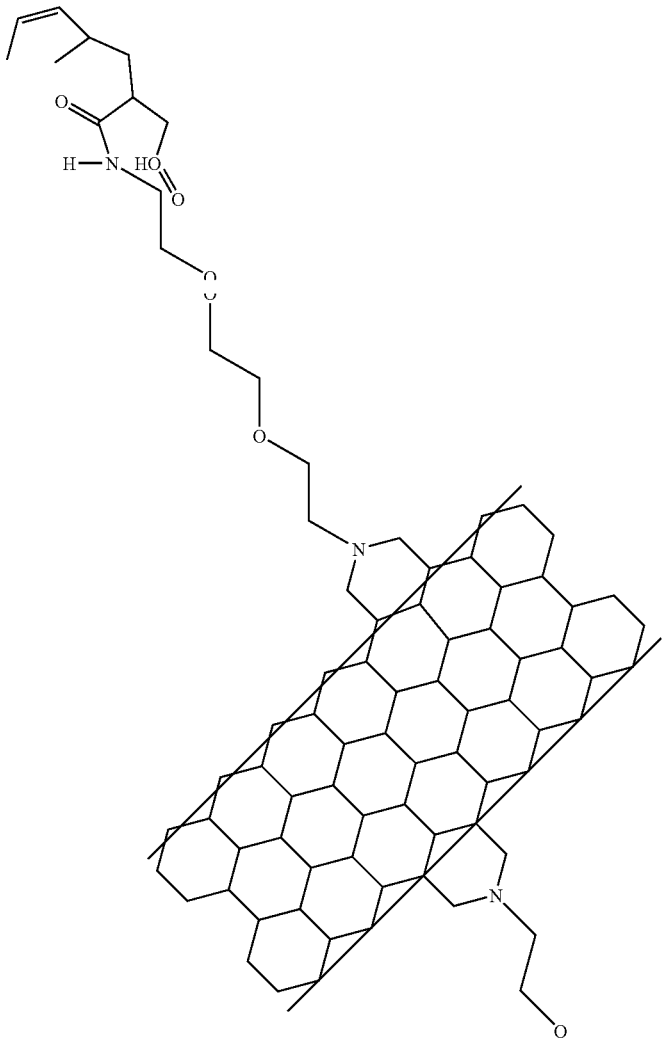

-continued

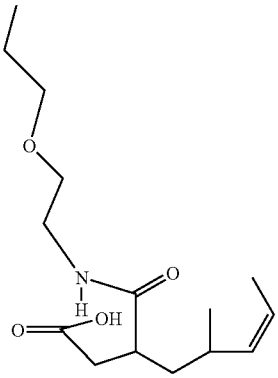

Paper-Forming Compounds

The paper-forming compound may be a cellulose-containing fiber material, such as paper pulps typically used in forming loudspeaker cones. Preferably, the paper-forming compound includes material described at least in part by formula (VIII) of cellulose below:

(VIII)

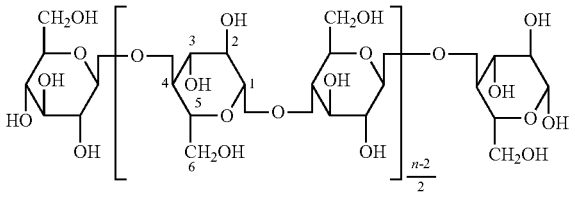

Non-limiting examples of the paper-forming compound include bleached northern or southern hardwood or softwood pulp. In another example, the paper-forming compound may also include other materials such as cotton fibers, synthetic fibers, modified synthetic fibers, suspension agents, and/or other components useful in paper loudspeaker cone compositions. The paper-forming compound may be modified such that the cellulose content includes a reactive moiety that may chemically bond with a variety of other paper-treatment compounds. Accordingly, the paper-forming compound may function as a de facto "functionalizing agent" to allow cellulose components to be chemically bonded to any number of paper-treatment compounds including resins or reinforced resins that may be added to paper compositions to improve strength, energy dissipation, water resistance, adhesive bonding capability and/or other properties of interest for acoustic diaphragm surfaces.

Loudspeaker Assembly Incorporating Paper Cones With Nanomaterials

A loudspeaker cone may include a CNT chemically bound (e.g. via ionic, covalent or hydrogen bonding) to cellulose. In another example, the loudspeaker cone may include one or more paper-treatment compounds or paper-forming compounds, which may be chemically bound to a modified CNT. The following examples employ certain combinations of material and process technology that may be used in concert to be beneficial for loudspeaker cone manufacturing, while yielding components with desirable acoustic performance. In loudspeaker cone manufacturing with plastics, two general areas that have significant bearing on acoustic performance are materials and processing. The degree or level of acoustic performance of a loudspeaker is related to the cooperative operation of a number of moving and non-moving parts associated with the loudspeaker.

Figure 5:
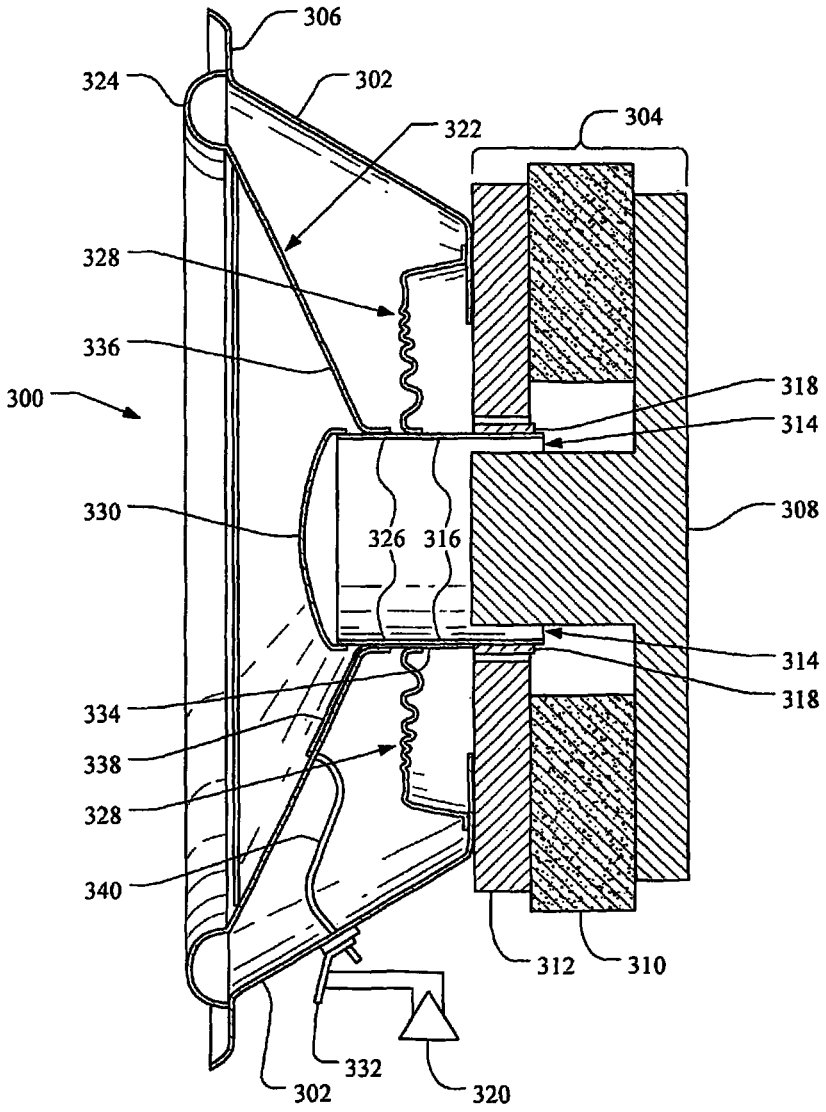
FIG. 5 is an example loudspeaker that may be mounted in a loudspeaker enclosure.

In FIG. 5, an example loudspeaker 300 is illustrated that may include a supporting frame 302 and a motor assembly 304. The frame 302 may include a lip 306 that extends outwardly from a main portion of the frame 302. The motor assembly 304 may include a back plate or center pole 308, a permanent magnet 310, and a front or top plate 312 that may provide a substantially uniform magnetic field across an air gap 314. A voice coil former 316 may support a voice coil 318 in the magnetic field. Generally speaking, during operation current from an amplifier 320 supplying electric signals representing program material to be transduced by the loudspeaker 300 drives the voice coil 318. The voice coil 318 may reciprocate axially in the air gap 314. Reciprocation of the voice coil 318 attached to speaker cone 322 may cause reciprocating cone movement that may create sound waves representing the program material transduced by the loudspeaker 300. The loudspeaker 300 may also include a cone 322. An apex of the cone 322 may be attached to an end of the voice coil former 316 lying outside the motor assembly 304. An outer end of the cone 322 may be coupled to a surround or compliance 324. The surround 324 may be attached at an outer perimeter to the frame 302. As set forth above, the frame 302 may also include the lip 306 that may be used to support mounting of the loudspeaker 300 in a desired location such as a surface or in a loudspeaker enclosure.

A spider 328 may be coupled at an outer perimeter of the spider 328 to the frame 302. The spider 328 may include a central opening 326 to which the voice coil former 316 is attached. A suspension including the surround 324 and the spider 328 may constrain the voice coil 318 to reciprocate axially in the air gap 314. In addition, the loudspeaker 300 may include a center cap or dust dome 330 that is designed to keep dust or other particulates out of the motor assembly 304 and may also serve an acoustic function.

The loudspeaker 300 may include a pair of loudspeaker terminals 332. The loudspeaker terminals 332 may provide a positive and negative terminal for the loudspeaker 300. A typical, although by no means the only, mechanism for completing the electrical connection between the loudspeaker terminals 332 and a pair of voice coil wires 334 is illustrated in FIG. 5. The voice coil wires 334 may be dressed against the side of the coil former 316, and pass through the central opening 326 and the intersection of the coil former 316 and the apex of the cone 322. In addition, the voice coil wires 334 may then be dressed across a face 336 of the cone 322 to a pair of connection points 338. At the pair of connection points 338, the voice coil wires 334 may be connected to a pair of flexible conductors 340. The flexible conductors 340 may be connected with the loudspeaker terminals 332. The pair of flexible conductors 340 may be made from tinsel, litz wire or any other suitable conductive material. The voice coil wires 334 may be fixed or attached to the face 336 of the cone 322 with an electrically non-conductive adhesive or any other suitable connection material.

The loudspeaker 300 set forth in FIG. 5 is illustrated with the frame 302, the cone 322, and the surround 324 formed in generally a circular shape. Different geometric loudspeaker shapes may also be used such as loudspeakers formed in the shape of squares, ovals, rectangles and so forth. In addition, the components that are used to form the loudspeaker 300 set forth above should be viewed in an illustrative sense and not as a limitation. Other components may be used to make the loudspeaker 300.

Figure 6:
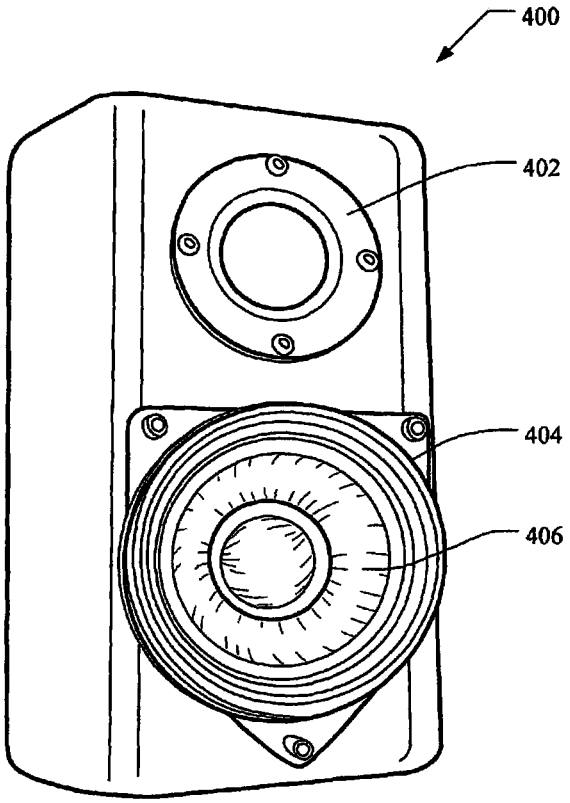
FIG. 6 is an example loudspeaker enclosure fitted with low frequency and high frequency loudspeakers.

FIG. 6 is an example loudspeaker enclosure 400 that includes a first loudspeaker 402 and a second loudspeaker 404. The first loudspeaker 402 is a tweeter, or high frequency driver operational in a high frequency range such as from about 5 kHz to about 25 kHz. The second loudspeaker 404 is a mid-range loudspeaker operational in a middle frequency range, such as about 100 Hz to about 6 kHz. The second loudspeaker 404 includes a cone body 406. In other examples, any other size and/or frequency range loudspeaker may be constructed to include a corresponding cone body 406. The cone body 406 may be formed by any of the exemplary systems and processes described herein.

Improvement in the stiffness and damping qualities of a cone body while maintaining relatively low weight of the cone body may provide acoustic benefits to a loudspeaker operating with such a cone body. Improved damping may eliminate acoustic reflection and other undesirable vibration of the loudspeaker cone. Improved stiffness may provide extension of the pass band frequency range of the loudspeaker. Lower weight may enhance the response characteristics of the loudspeaker due to the lower mass being vibrated to produce sound. The stiffness, weight and damping characteristics may all provide enhanced performance of the loudspeaker, however, improvement in one or more of the characteristics (or parameters) can result in deterioration in the desirability of one or more other characteristics.

EXAMPLES

Examples 2-3 are representative examples of different processes to incorporate nanomaterials into a paper composition by modifying different steps in the paper making process described in Comparative Example 1. These examples also illustrate other processes that incorporate nanomaterials into paper compositions at two or more steps in a paper making process, for example by including multiple steps described in two or more of Examples 2-3. The paper making process provided in Comparative Example 1 is a non-limiting representative example of a paper making process that may be modified according to the processes described in this disclosure to include nanofiller materials at one or more steps in the paper making process. The steps described in Examples 2-3 and elsewhere in the specification may be used with any other suitable paper making process, either individually or in combination. In the examples below, carbon nanotubes are used as the nanofiller.

Comparative Example 1

Preparing Paper Pulp Slurry Composition Without CNTs

A paper pulp slurry composition suitable for forming a loudspeaker cone may be prepared without carbon nanotubes (CNTs). The resulting pulp slurry composition, as described according to Table 1 below, may be filtered, pressed and formed into a loudspeaker cone according to conventional methods. In each step, the relative weights of each component may be selected to provide a final composition with relative parts by weight of each component according to Table 1. Table 1 also includes an example with the relative component weights for a 60 gallon pulp slurry that may be mixed in a 110 gallon tank. This batch size may be representative of a production-size lot intended for making paper speaker cones.

In a first step, a first suspension is formed by combining a 5 wt % solids of paper pulp (e.g., Harmack K10) and cotton linter (Southern Cellulose Grade 282) in water at room temperature and stirring for about 90 minutes. The first suspension optionally further includes a dye.

In a second step, the first suspension may be combined with a suitable wet strength agent (WSA) and stirred for about 5 minutes to form a second suspension having a total of about 5-wt % of all solids in the aqueous suspension. The wet strength agent may be provided as a 12.5% w/w aqueous solution that is diluted to 1 wt % with water to form the aqueous solution of WSA that is added to the first suspension. Sufficient WSA is added to form a second suspension having from about 0.2 to 1.2 wt % of WSA with respect to all solids present in the second suspension. In the composition described in Table 1, 300 mL of the 12.5 wt % wet strength agent are used.

In a third step, the second suspension may be combined with a thermoplastic micro fiber (e.g., polypropylene microfibers) and stirred to form a third suspension. Optionally, additional fillers (e.g., clay, calcium bicarbonate, titanium dioxide, talc, and the like) may be added to the second suspension and contained within the third suspension. In addition, alum may be added to acidic paper compositions or sodium aluminate may be added to alkaline paper compositions. Water may be added to the second suspension to provide a third suspension having about 5% wt total solids. The mass may be transferred to a holding tub and left to stand for about 20 minutes.

In a fourth step, the third suspension may be combined with a reactive sizing agent (e.g., AKD) to form a fourth suspension. For AKD size, the sizing agent is provided as (e.g., 1800 mL) a 15.5% wt aqueous solution (w/v) and that is diluted 2:1 with water and introduced to provide a 4.8 wt % AKD solution based on solids. Sufficient sizing agent may be added to the third suspension to form a fourth suspension that has approximately 2-wt % of AKD with respect to all solids present in the fourth suspension. In the example provided by Table 1, 1800 ml of the 15.5 wt % sizing agent, subsequently diluted with 4000 ml of water, may be added to the furnish.

In a fifth step, the fourth suspension is diluted with water to reduce the net solids. In the example provided by Table 1, a 15:1 water dilution of the fourth suspension reduced the net solids to 0.3 wt %. The resulting diluted fourth aqueous suspension is filtered. The filter screen may have pores of up to about 200 micrometers in any one direction. Water is removed from the pulp to form a filter cake. The resulting filter cake may be subsequently heated to remove water, molded and cured to form a speaker cone. Optionally, a surface-sizing agent may be contacted with the filter cake prior to heat forming of the speaker cone.

TABLE 1

| Component | Exemplary Product | Parts by Weight (final slurry) | Exemplary Component Weight (60-gallon sample) (kg) |
|---|---|---|---|
| Pulp | Harmac K10 Softwood Bleached Kraft Wood Pulp | 1.00 | 10.34 |
| Cotton Linter | Grade 282 | 0.053 | 0.55 |
| Dye | Black JX-AJ-1 | 0.058 | 0.60 |
| Wet Strength Agent (WSA) | Kymene 557H | 0.0038 | 0.039 |
| Fiber | Polypro Fybrel Y600 | 0.319 | 3.3 (dry wt) |
| Alum | Aluminum Sulfate | 0.058 | 0.6 |
| Sizing Agent (SA) | Hercon79 (AKD reactive sizing agent) | 0.027 | 0.28 |

Example 2

Production of Modified CNTs by Direct Fictionalization

A carbon nanotube (CNT) may be directly modified to form a modified CNT (mCNT) containing a first moiety capable of associating and/or chemically binding to cellulose stock and papermaking additives in a paper making composition In one example, direct modification may be performed by contacting a CNT with aqueous sulfuric acid ($H_2SO_4$) and nitric acid ($HNO_3$) to introduce carboxylic acid groups as a first moiety covalently bound to the exterior surface of the CNT structure.

Example 3

Production of Modified CNTs with a Functionalizing Agent

A carbon nanotube (CNT) may be combined with a functionalizing agent (e.g., a PAE polymer) to form a modified CNT (mCNT) containing a first moiety capable of associating and/or chemically binding to a papermaking stock (e.g., cellulose) and/or a papermaking additive. The modified CNT may be formed by contacting a CNT with a functionalizing agent such as a substituted poly(arylene ethynylene) polymer that chemically binds to the CNT while presenting first reactive binding moieties suitable to subsequently associate and/or chemically bind to a paper-forming compound and/or a paper-treatment compound. Examples of substituted poly (arylene ethynylene) polymers are provided in US patent publication US2006/0054866 (filed Apr. 13, 2005, Ser. No. 11/105,078, by Ait-Haddou et al) according to the formula:

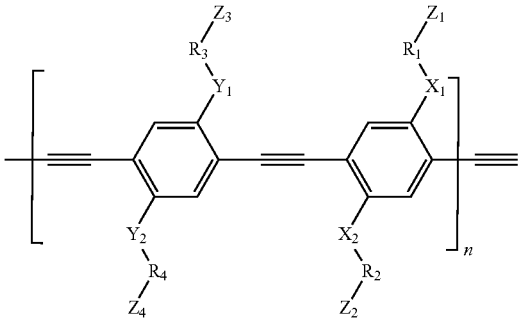

where n is about 20-190; $X_1R_1$, $X_2R_2$, $Y_1R_3$, $Y_2R_4$, and $Y_2R_2$ are either electron donating or electron withdrawing groups such that when $X_1R_1$ and $X_2R_2$ are electron donating groups, then $Y_1R_3$ and $Y_2R_4$ are electron withdrawing and vice versa; $X_1$, and $Y_2$ and $X_2$, and $Y_2$ are independently COO, CONH, CONHCO, COOCO, CONHCNH, CON, COS, CS, alkyl, aryl, allyl, N, NO, S, O, SO, CN, CNN, SO2, P or PO; and $R_1$-$R_4$ are independently alkyl, phenyl, benzyl, aryl, allyl or H. The $Z_1$-$Z_4$ moieties may be selected to provide a modified CNT that is water dispersible and/or stabilize dispersions of the mCNT in a desired solvent media. For example, the $Z_1$-$Z_4$ substituents may be independently selected to provide desired reactivity and/or solubility properties to the modified carbon nanotube. In particular, in certain examples, the $Z_1$-$Z_4$ substituents may be independently selected from the group consisting of: an acetal, acid halide, acrylate unit, acyl azide, aldehyde, anhydride, cyclic alkene, arene, alkene, alkyne, alkyl halide, aryl, aryl halide, amine, amide, amino, amino acid, alcohol, alkoxy, antibiotic, azide, aziridine, azo compounds, calixarene, carbohydrate, carbonate, carboxylic acid, carboxylate, carbodiimide, cyclodextrin, crown ether, CN, cryptand, dendrimer, dendron, diamine, diaminopyridine, diazonium compounds, DNA, epoxy, ester, ether, epoxide, ethylene glycol, fullerene, glyoxal, halide, hydroxy, imide, imine, imidoester, ketone, nitrile, isothiocyanate, isocyanate, isonitrile, ketone, lactone, ligand for metal complexation, ligand for biomolecule complexation, lipid, maleimide, melamine, metallocene, NHS ester, nitroalkane, nitro compounds, nucleotide, olefin, oligosaccharide, peptide, phenol, phthalocyanine, porphyrin, phosphine, phosphonate, polyamine, polyethoxyalkyl, 2,2'-bipyridine, 1,10-phenanthroline, terpyridine, pyridazine, pyrimidine, purine, pyrazine, 1,8-naphthyridine, polyhedral oligomeric silsesquioxane (POSS), pyrazolate, imidazolate, torand, hexapyridine, 4,4'-bipyrimidine, polypropoxyalkyl, protein, pyridine, quaternary ammonium salt, quaternary phosphonium salt, quinone, RNA, Schiff base, selenide, sepulchrate, silane, a styrene unit, sulfide, sulfone, sulfhydryl, sulfonyl chloride, sulfonic acid, sulfonic acid ester, sulfonium salt, sulfoxide, sulfur and selenium compounds, thiol, thioether, thiol acid, thio ester, thymine, and combinations thereof.

The poly(arylene ethynylene) polymers are preferably poly(phenylene ethynylene) polymers, as described above. Optionally, up to three chemical moieties selected from the group consisting of: —$Y_1R_3Z_3$, —$X_1R_1Z_1$, —$Y_2R_4Z_4$ and —$X_2R_2Z_2$ in the poly(arylene ethynylene) polymers may be replaced with hydrogen bound to the arylene ring. The poly (phenylene ethynylene) polymers may be mixed with multi-walled carbon nanotubes and a dispersion/solubilization solvent such as water or organic solvents such as methylethylketone (MEK), acetone, methanol, toluene and the like. Preferably, $Z_1$-$Z_4$ may independently include a chemical moiety selected from the group consisting of:

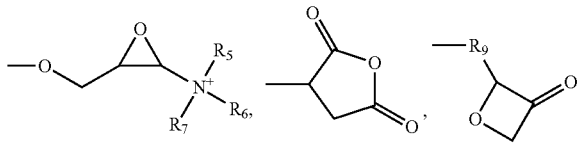

—OH, —NCO, —$NHR_8$ and phenol, where $R_5$-$R_9$, are independently hydrogen or linear or branched olefin groups. One or more of the $Z_1$-$Z_4$ moieties may function as the first binding moiety to associate and/or chemically bind to a paper-forming compound and/or a paper-treatment compound to form an adduct. Most preferably, $Z_1$-$Z_4$ may independently include a —$NH_2$, —COOH, acid anhydride, optionally substituted amines, epoxies or glycidyl ether groups.

For example, the CNTs may be combined with the poly (phenylene ethynylene) polymer at a CNT:polymer weight ratio of about 2:1 in the presence of water at a concentration of about 8 mg CNT/mL water. The resulting mCNT may contain organic acid or basic groups in their ionic (salt) form. The mixture may be sonnicated at 25° C. for about 30 minutes to produce a water-soluble dispersion of modified CNTs. The CNT, prior to modification, may be obtained commercially, for example from the Arkema Group, France (Graphistrength™ 100P50). The dispersion is present under pH conditions that cause one or more of the Z groups of the mCNT to be present in the ionic (salt) form. The dispersion can be filtered through a steel filter having a porosity of about 10-20 micrometers. The resulting black powder may be dispersed in solvents such as methanol, ethanol, or ethylene glycol. The dispersed material in water may be precipitated out of the dispersion by neutralization with a small amount of an acid. Other details for forming the modified CNT are described in US 2006/0054866 A1, incorporated herein by reference.

Water-dispersions of modified CNT compositions may be provided (for example as a 0.5% wt dispersion in water). The poly(phenyleneethynylene) polymers including —NH2 Z groups are water-soluble at acidic pH (pH greater than 7). Other water-dispersible modified CNT compositions include poly(phenyleneethynylene) polymers having —COOH groups that may be dispersed in water at a basic pH (less than 7). To associate and/or chemically bind a modified CNT to a paper-forming compound or a paper-treatment compound at one or more steps in the process of Example 1, the pH of one or more suspensions may be adjusted to provide a desired balance of reactivity and solubility of the modified CNT. Accordingly, the pH may be altered or controlled during the association and/or binding process to retain a stable water suspension of the modified CNT that will also readily associate and/or bind to a moiety of the paper-forming compound or paper-treatment compound. The pH may be altered between steps so as to preserve a desired dispersion or solubility of reactive species in a dispersion and prevent precipitation or agglomeration of adducts or modified CNT molecules.

Example 4

Depositing and Retaining mCNTs onto Cellulose Fibers during Wet End Processing A set of small scale experiments were constituted to illustrate the effects of various retention aides in promoting deposition and retention of modified CNTs (mCNT) onto cellulose fibers in advance of dry end papermaking. The mCNTs were selected to be amine functionalized (CNT-NH2; approximately 0.08 mmole amine/gm CNT solids) or carboxylic acid functionalized (CNT-COOH; approximately 0.26 mmole acid/gm CNT solids). Both materials were provided as 0.5 wt % aqueous dispersions (Zyvex, Inc) with pHs of about 10 to 12 and about 7 to 8 respectively. The surface charge characteristics were believed to be anionic. Pulp and linter (about 14 to 15 gms) were combined with approximately 400 ml of water to provide a slurry with the approximate proportions given in Example 1. The mass was filtered to a wet cake consistency of approximately 30 to 35 wt % solids. About six-gram portions were separated from the wet cake and placed in a clean 4 oz plastic cup. About ten ml of an approximately 0.5 wt % mCNT dispersion were added and periodically, but thoroughly, hand stirred over an approximate 2-hour period to saturate the fibers with mCNT. The mass was pressed with a flat spatula, and lightly contacted with an absorbent tissue to remove excess water and CNTs. A small portion—about 0.35 gms—of the CNT saturated pulp was placed in a second clean cup and approximately 30 mls of water was added. The mass was vigorously hand-stirred and suspended to create a simulated "thin stock" containing cellulose pulp and mCNTs.

Various additives such as retention aides, and sizing were separately prepared into dilute solutions as described in Table 2. These additives were then introduced to the pulp-CNT suspension individually or in combinations and sequences as summarized in Table 2. The suspension was stirred for approximately 30 seconds after each addition. The resulting mixture was filtered through a porous paper filter (such as a coffee filter) to collect and separate the solids from the process water. The solids were dried in a forced air oven at about 105 degrees Celsius.

The solids were examined and found to exhibit various shades of gray to black. Since no extraneous dyes were added, these shade differences provided a ready means to compare the relative amounts of CNTs retained onto the cellulose. Such shading may be further qualified using a Gray Scale or related testing procedure (ISO 105-A02) that is utilized by the paper and textile industries. A second means to evaluate CNT retention is provided by the appearance of the process water after filtration, and upon standing. When retention is good, the process water is relatively clear and there are little or no suspended materials. As retention becomes increasingly poor, the filtered water takes on a progressively darker appearance. Upon standing, the filtrate may coagulate to form various amounts of a solid precipitate consisting mainly of un-retained CNT material. A third means of evaluating relative retention was to examine the dry cellulose material with a stereomicroscope at 100× magnification. Dark colored samples with clean filtrates show more extensive "sheathing" of CNT deposits that are well dispersed onto the pulp surface. Samples with poor retention show relatively small amounts of isolated deposits and particulates that appear to be retained (vs. dispersed onto) the cellulose mass. The results of these determinations are summarized in Table 2.

TABLE 2

Deposition and Retention of mCNTs onto Cellulose Fibers

| | 1 | 2 | 3 | 4 | 5 | 6 | 7 | 8 | 9 | 10 |
|---|---|---|---|---|---|---|---|---|---|---|
| | Cellulose Wood | | mCNT | | Retention Aides/Control Additives | | | | | Size |
| Sample # | Cotton Linter | KJ Pulp | CNT-NH2 | CSH-CH2-B | DI 759 | DI 775 | Alum | N-Alm | PA 1027 | ASA |
| 1-Control | Y | Y | Y | N | N | N | N | N | N | N |
| 2 | Y | Y | Y | N | N | N | N | Y | N | N |
| 3 | Y | Y | Y | N | N | N | N | N | Y | N |
| 5 | Y | Y | Y | N | N | Y | N | N | Y | N |
| 6 | Y | Y | Y | N | Y | N | N | Y | Y | N |
| 7 | Y | Y | Y | N | N | N | Y | N | N | N |
| 10-Control | Y | Y | N | Y | N | N | N | N | N | N |
| 11 | Y | Y | N | Y | N | N | N | Y | N | N |
| 12 | Y | Y | N | Y | N | N | N | Y | N | N |
| 13 | Y | Y | N | Y | Y | Y | N | N | Y | N |
| 14 | Y | Y | N | Y | Y | N | N | N | Y | N |
| 16 | Y | Y | N | Y | N | Y | Y | N | N | N |
| Alt. Addition Order | | | | | | | | | | |
| 23 | Y | Y | Y | N | N | N | Y | N | N | N |
| 24 | Y | Y | N | Y | N | N | Y | N | N | N |
| ASA Sized | | | | | | | | | | |
| 29 | Y | Y | Y | N | N | Y | Y | N | Y | Y |
| 31 | Y | Y | N | Y | N | Y | Y | N | Y | Y |
| Batch Coat Only Add'ln | | | | | | | | | | |
| 32 | Y | Y | N | Y | N | Y | N | N | N | |
| 34 | Y | Y | Y; pH = 12 | N | N | Y | N | N | N | |

1 = Black (High Retention)

4 = Lt. Gray (Poor Retention)

| Sample # | Addition Order | Filter Water | Gray Scale | pH | Wet Stock Formation |
|---|---|---|---|---|---|
| 1-Control | 1, 2, 3 | Dark; No Ppts. | 4 | 8.75 | Little to no Coagulation |
| 2 | 1, 2, 3, 8 | Clear; Extensive Ppts. | 3.5 | 8.28 | Little to no Coagulation |
| 3 | 1, 2, 3, 9 | Dark Extensive Ppts. | 3.5 | 8.55 | Little to no Coagulation |
| 5 | 1, 2, 3, 6, 9 | Clear; No Ppts. | 1.5 | 8.3 | Coagulated |
| 6 | 1, 2, 3, 5, 8, 9 | Clear; Trace Ppts. | 2.5 | 9.11 | Coagulated |
| 7 | 1, 2, 3, 7 | Clear; Slight/Moderate Ppts. | 2 | 7.88 | Little to no Coagulation |
| 10-Control | 1, 2, 4 | Dark; Moderate Ppts | 3.5 | 7.39 | Moderate coagulation |
| 11 | 1, 2, 4, 8 | Clear; Extentive Ppts | 4 | 8.72 | Moderate coagulation |
| 12 | 1, 2, 4, 9 | Dark; Slight Ppts. | 3.5 | 8.13 | Moderate coagulation |
| 13 | 1, 2, 4, 5, 9 | Almost Clear; No Ppts. | 2 | 8.16 | Coagulated |
| 14 | 1, 2, 4, 6, 9 | Clear; No Ppts. | 2 | 8.16 | Coagulated |
| 16 | 1, 2, 4, 7 | Clear; No Ppts. | 1.5 | 5.86 | Little to no Coagulation |
| Alt. Addition Order | | | | | |
| 23 | 1, 2, 7, 3 (cf #7) | Dark; Slight/Moderate Ppts | 4 | 7.81 | Little to no Coagulation |
| 24 | 1, 2, 7, 4 (cf #16) | Clear; No Ppts. | 2.5 | 6.62 | Moderate coagulation |
| ASA Sized | | | | | |
| 29 | 1, 2, 7, 10, 3, 6, 9 | Clear; No Ppts. | 1.5 | 7.75 | Coagulated |
| 31 | 1, 2, 4, 6, 10, 9 | Clear; No Ppts. | 1.5 | 7.71 | Coagulated |
| Batch Coat Only Add'ln | | | | | |
| 32 | 1, 2, 6, 4 | Clear; No Ppts. | 2 | 7.55 | Coagulated |
| 34 | 1, 2, 6, 3 | Almost Clear; Moderate Ppts. | 1.5 | 7.83 | pH of CNT-NH2 = 12 new lot |

TABLE 2-continued

| Additives: |
|---|
| Hercules D1259 - "Patch" type retention aide additive (DADMAC): provided as a 1 wt % aqueous solution |
| Hercules D1274 - "Patch" type retention aide additive: (Poly Quatemary Amine) provided as a 1 wt % aqueous solution |
| Hercules PA8137 - "Bridge" type retention aide additive (Anionic Poyacrylamide): Provided as a 0.5 wt % Aqueous solution |
| Alum—Aluminum Sulfate - provided as a 0.125 wt % aqueous solution (0.5 gm/400 ml) |
| NaAlm—Sodium Aluminate - provided as a 0.125 wt % aqueous solution (0.5 gm/400 ml) |
| ASA - Prequel 2000/Prequel 500 alkenyl succinic anhydride sizing agent and starch; provided as a 1 wt % solids emulsion |
| CNT-NH2, CNT-COOH - Zyvex Inc., amine and acid functionalized CNTs. provided as 0.5 wt % water dispersions |
| Screening Formulation: |
| First Furnish |
| 6 gms cellulose wet stock = approximately 2 gms solids |
| 10 ml 0.5 wt % mCNT (an excess to saturate and cover the cellulose fiber surfaces |
| Final Furnish |
| 0.35 gms Cellulose + mCNT above wet stock = approximately 0.10 gms solids |
| 0.15 gm of each retention aide to be utilized (= 3 drops of stock solution), and/or 3.3 mls alum or 2.2 mls sodium aluminate solution |
| 0.22 gm of ASA 1 wt % emulsion, when applicable |

Example 5

Incorporating Cellulose-Bound mCNTs into Paper Compositions Suitable for Preparing Speaker Cones An exemplary procedure for preparing a 3 inch diameter flat test specimen or a 3 inch diameter×0.5 inch tall cone shape with approximate weights of 1.25 grams is provided.

A furnish is prepared in accordance with one or more of the variants described in Table 2. The slurry is prepared to contain about 14.25 gms of cellulose stock and various papermaking additives combined initially with approximately 400 ml of water. The mixture is diluted to about 4.8 liters with water to form a "thin stock" suspension with a consistency of approximately 0.3 wt %. The thin stock suspension is vigorously stirred to maintain a uniform suspension. Aliquots of about 420 ml each are removed using a marked receptacle, and filtered through a 200-mesh stainless steel screen to form the paper and separate the solid pulp from the process water. The screen is fixed to a 1 liter vacuum filtering apparatus wherein the vacuum may be adjusted to control the maximum degree of water flow and shear created by the filtering action. An initial wet cake of approximately 30 to 35 wt % consistency is formed. The example herein produces a dry paper mass of about 1.25 gms. However, the aliquot volume and the % solids of the initial thin stock may be adapted to produce other desired amounts of net solids contained in the cake. The filtering screen may be selected to be flat, or to have a desired cone-like profile.

Example 6

Exemplary Procedures for Consolidating and Molding Cellulose-Bound mCNT Containing Paper Compositions into Various Shapes, Including Speaker Cones The wet filtrate of Example #5 having a desired net solids weight and gross geometry and dimensions may be further manipulated by a direct molding process to create samples to a final desired net shape and weight. In a typical instance, the initial wet cake at about 30 to 35 wt % solids is further prepared in a small vertical press equipped with a shaped fixture and compacted to a pre-molding consistency of approximately 50 to 60 wt % solids. The actual net % solids may be adjusted to achieve a good balance between shape formation while avoiding rupture of the molding caused by a buildup of excessive steam pressure and out-gassing. The less damp mass is then placed in a pre-heated and vented die mounted in a vertical press. The mass is hot pressed at about 425 degrees Fahrenheit for approximately 140 seconds at a clamp pressure of about 700 psi. Shims, e.g., 0.010 inch steel strips, may be placed between the tool faces to control the degree of compaction. The thickness of the resulting 1.25 gram×3 inch disc specimen is approximately 0.016 inch (0.4 mm).

Test specimens and cones prepared by the direct molding process discussed in the foregoing paragraphs of Example 6 may be evaluated to provide properties comparisons. In one test, the shear modulus is determined using a TA Instruments ARES DMA instrument. Rectangular specimens 0.5 inch× 1.25 inch were extracted from molded test disc using a precision punch and die. The samples were weighted, dimensioned, and tested in a torsion mode on the DMA at about 1 or 10 Hz, 20 degrees Celsius, and at low strain to determine G', the shear modulus. The sample density and the specific modulus, i.e., G'/density, may then be calculated to provide a measure of stiffness to weight ratio. These results are summarized in Table 3.

TABLE 3

Paper Cone Formulation and Test Data

| Description of System Evaluated | Sample Number | Composition Variation: K10 Bich Pulp | Y600 PPMF | 262R Ctn Linter | Alum Ph <7 | Sodium Aluminate | Control Additive | Kymen @ 557H WSA | Hercon 79 AKD Size | Prequel ASA Size |
|---|---|---|---|---|---|---|---|---|---|---|
| Control Examples-Stock Only/No PP + WSA/Size + Alum or NaALm | | | | | | | | | | |
| | 1 | Y | N | Y | Y | N | N | Y | Y | N |
| | 18 | Y | N | Y | Y | N | N | Y | N | Y |
| | 19 | Y | N | Y | N | Y | Y; D1274 | Y | N | Y |
| Control Examples-Stock + PP Microfiber + WSA/Size + Alum or NaALm | | | | | | | | | | |
| | 2 | Y | Y | Y | Y | N | N | Y | Y | N |
| | 16 | Y | Y | Y | Y | N | N | Y | N | Y |
| | 17 | Y | Y | Y | N | Y | Y; D1274 | Y | N | Y |
| Control Examples-Stock Only + PP WSA/Size + NaALm or + Retention Aides | | | | | | | | | | |
| | 13 | Y | Y | Y | N | Y | Y; PA8137 | Y | Y | N |
| | 14 | Y | Y | Y | H | Y | Y; D1274 | Y | Y | N |
| Stock + mCNTs + PP - No WSA/ Size - W/WO alum | | | | | | | | | | |
| | 7 | Y | Y | Y | N | N | NaOH | N | N | N |
| | 8 | Y | Y | Y | Y; last | N | NaOH; then alum | N | N | N |
| | 9 | Y | Y | Y | N | N | NaOH | N | N | N |
| | 10 | Y | Y | Y | Y; last | N | NaOH; then alum | N | N | N |
| Stock + mCNTs + PP + WSA/Size, with added NaOH w/wo alum | | | | | | | | | | |
| | 3 | Y | Y | Y | N | N | NaOH | Y | Y | N |
| | 4 | Y | Y | Y | Y; last | N | NaOH; then alum | Y | Y | N |
| | 5 | Y | Y | Y | N | N | NaOH | Y | Y | N |
| | 6 | Y | Y | Y | Y; last | N | NaOH; then alum | Y | Y | N |
| Stock + mCNTs + PP - No WSA/ Size - with alum | | | | | | | | | | |
| | 11 | Y | Y | Y | Y; then CNT | N | N | N | N | N |
| | 12 | Y | Y | Y | Y; then CNT | N | N | N | N | N |
| Stock + mCNTs + PP +WSA/ Size - NoAlm + Retention Aide | | | | | | | | | | |
| | 15 | Y | Y | Y | N | Y | Y; D1274 | Y | N | Y |

| Description of System Evaluated | Sample Number | mCNTs: CNT-NH2 in Water | CNT-COOH in Water | DMA Results: G' 20° C. MPa | Tan Delta 20° C. | Mullins Burst Strength, PSI | Type Break (# Samples) B = Brittle D = Ductile | Physical Data: Wt. gm DMA PfO | Thick-ness mm | Density gm/cm ^3 | Specific Modulus MPa | Wt % CNT Based on Solids |
|---|---|---|---|---|---|---|---|---|---|---|---|---|
| Control Examples-Stock Only/No PP + WSA/Size + Alum or NaALm | | | | | | | | | | | | |
| | 1 | N | N | 2250 | 0.034 | 11 | B (2) | 0.1085 | 0.377 | 0.711 | 3166 | 0.0 |
| | 18 | N | N | 2169 | 0.040 | 88 | D (6) | 0.127 | 0.393 | 0.798 | 2718 | 0.0 |
| | 19 | N | N | 2645 | 0.033 | 76 | D (6) | 0.132 | 0.368 | 0.840 | 3148 | 0.0 |
| Control Examples-Stock + PP Microfiber + WSA/Size + Alum or NaALm | | | | | | | | | | | | |
| | 2 | N | N | 3752 | 0.025 | 158 | D (6) | 0.1194 | 0.34 | 0.867 | 4326 | 0.0 |
| | 16 | N | N | 3545 | 0.030 | 142 | D (6) | 0.121 | 0.331 | 0.093 | 3929 | 0.0 |
| | 17 | N | N | 3186 | 0.034 | | | 0.124 | 0.35 | 0.875 | 3642 | 0.0 |
| Control Examples-Stock Only + PP WSA/Size + NaALm or + Retention Aides | | | | | | | | | | | | |
| | 13 | N | N | 3511 | 0.037 | 151 | D (1) | 0.130 | 0.370 | 0.868 | 4047 | 0.0 |
| | 14 | N | N | 3470 | 0.034 | 143 | D (1) | 0.110 | 0.346 | 0.785 | 4420 | 0.0 |

TABLE 3-continued

| | | | | | | | | | | | | |
|---|---|---|---|---|---|---|---|---|---|---|---|---|
| Stock + mCNTs + PP - No WSA/ Size - W/WO alum | | | | | | | | | | | | |
| | 7 | Y | | 3363 | 0.029 | 103 | D (2) | 0.1256 | 0.363 | 0.862 | 3888 | 1.875 |
| | 8 | Y | | 4121 | 0.023 | 24 | B (1) | 0.1211 | 0.347 | 0.862 | 4702 | 1.875 |
| | 9 | | Y | 3995 | 0.023 | 82 | D (2) | 0.1330 | 0.374 | 0.876 | 4550 | 1.875 |
| | 10 | | Y | 4214 | 0.022 | 16 | B (1) | 0.1296 | 0.352 | 0.909 | 4635 | 1.875 |
| Stock + mCNTs + PP + WSA/Size, with added NaOH w/wo alum | | | | | | | | | | | | |
| | 3 | Y | | 4839 | 0.022 | 114 | D (4) | 0.1332 | 0.337 | 0.976 | 4969 | 1.5 |
| | 4 | Y | | 3306 | 0.025 | 30 | B (5) | 0.1277 | 0.364 | 0.866 | 3909 | 1.5 |
| | 5 | | Y | 3877 | 0.026 | 143 | D (4) | 0.1415 | 0.381 | 0.917 | 4228 | 1.876 |
| | 6 | | Y | 4210 | 0.025 | 26 | B (5) | 0.1304 | 0.352 | 0.915 | 4603 | 1.975 |
| Stock + mCNTs + PP - No WSA/ Size - with alum | | | | | | | | | | | | |
| | 11 | Y; kast | | 3055 | 0.025 | 26 | B (5) | 0.1442 | 0.363 | 0.981 | 3115 | 1.875 |
| | 12 | | Y; last | 3649 | 0.026 | 19 | D (4) | 0.1223 | 0.344 | 0.876 | 4157 | 1.875 |
| Stock + mCNTs + PP +WSA/ Size - NoAlm + Retention Aide | | | | | | | | | | | | |
| | 15 | Y; added last | N | 6564 | 0.033 | 129 | D (6) | 0.129 | 0.36 | 0.665 | 4026 | 2.5 |

| | | | | | |
|---|---|---|---|---|---|
| Standard Process Conditions: | | | | | |
| Mold Temperature. degF | 425 | | | | |
| Cycle Time Seconds | 140 | | | | |
| Clamp Pressure. psi | 700 | | | | |
| Shim Size. 0.001 inch | 10 | | | | |
| Basic Formulation/Furnish | | | | | |
| For 1/1000 Production Batch Size | | | | 1/1000 | |
| Stock | | | | Lab Batch | Unit |
| Wood Cellulose (Bleached Pulp) | Pope & Talbon | K10 | | 10.40 | gm |
| Cotton Liner | Southern Cell | 282 Ft | | 0.55 | gm |
| Functional Additives | | | | | |
| PP Microfibers | MiniFiber | Y600 | | 3.30 | gm |
| Wet Strength Agent (WSA) | Hercules | 557H | Kymene | 0.30 | mls- 12.5 wt % aq. soln |
| Size-AKD | Hercules | 79 | Hercon | 28.00 | mls- 1 wt % aq. soln |
| Size-ASA | Hercules | 2000 | Prequal | 28.00 | mls- 1 wt % aq. soln |
| Amine CNT (CNT-NH2) | Zyvex | 0.5 wt % Aq | Nanosolve | As req'd | 0.5 wt % aq. Dispersion |
| Carboxylic Acid CNT (CNT-COOH) | Zyvex | 0.5 wt % Aq | Nanosolve | As req'd | 0.5 wt % aq. Dispersion |
| Control Additives | | | | | |
| Aluminum Sulphate | Various | | | 0.6 | gm |
| Sodium Aluminate | Various | | | 0.4 | gm |
| Poly(Quaternery Amine) | Hercules | D1274 | | 1.5 | mls 1.0 wt % aq. soln. |
| Anionic PolyAcrylamide | Hercules | PA8137 | | 1.0 | mls 0.5 wt % aq. soln. |
| Sodium Hydroxude | Various | | | As req'd | 0.025N |
| Water | | | | | |
| Thick Stock | Distilled | | | 400 | ml |
| Thin Stock | Tap | | | 4800 | ml |
| Note: | | | | | |

One or more items may be eliminated to accomplish the particular systems described in Table 3.

Example 7

Solubility Evaluation of Paper Containing Bound Modified CNTs

Two different dried paper samples with bound modified CNTs were tested: three samples (1-3) obtained in the manner described in Example 6, sample 8 and one sample obtained in the manner described in Example 6, sample 13 (sample 4). Sample 1-3 used the mCNT-NH2 mCNT composition to form the bound mCNT and sample 4 used the mCNT-COOH mCNT composition. Each sample was contacted with one of the three solvents for at least 8 hours in separate sample glass vials. The resulting color of the composition in each vial was evaluated for visual appearance. A clear appearance indicates that the mCNT remained bound to the dried paper sample in the presence of the solvent. A cloudy composition indicates a limited amount of unbound mCNT extracted from the dried paper sample. An opaque appearance would indicate that substantially none of the mCNT was bound to the dried paper sample. The mCNT compositions used in this Example are soluble in acetone prior to contact with a cellulose-containing paper forming composition.

| Sample | Solvent | mCNT | Alum | Appearance |
|---|---|---|---|---|
| 1 | Toluene | CNT-NH2 | Y, at end | Clear |
| 2 | Ethanol | CNT-NH2 | Y, at end | Clear |
| 3 | Acetone | CNT-NH2 | Y, at end | Cloudy |
| 4 | Acetone | CNT-COOH | Y, at end | Clear |

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method of forming a loudspeaker cone comprising:

(a) contacting in a liquid medium a modified carbon nanotube that includes a first binding moiety with at least one of a paper-forming compound and a paper-treatment compound having functional additives and control additives in a manner effective to retain the modified carbon nanotube to the one of the paper-forming compound and the paper-treatment compound to form a first adduct, the paper-forming and the paper-treatment compound together forming a paper compound; and (b) forming the loudspeaker cone by;

(i) removing the liquid medium from the paper compound and the first adduct; and (ii) reacting the first adduct with the paper compound in a manner effective to chemically bind the modified carbon nanotube to the paper compound;

(iii) where the step of forming the loudspeaker includes forming a filter mass containing the paper compound, the first adduct and residual liquid medium, and the step of reacting the first adduct includes heating the filter mass in a manner effective to substantially remove the residual liquid medium and cure the first adduct with at least one of the control additives, functional additives and the paper forming compound.

2. The method of claim 1, where the paper-forming compound is a papermaking cellulose stock, the control additives including a retention aide and at least one of a formation aide, a drainage agent, a foam control, a biocide, a corrosion control additive and a buffer, and the step of contacting in the liquid medium includes contacting the modified carbon nanotube with at least one of the papermaking cellulose stock and the retention aide to form the first adduct and adding the functional and control additives to the liquid medium to form a final furnish defining the paper compound in the liquid medium.

3. The method of claim 1, where the paper-forming compound includes cellulose fibers and the first adduct includes the modified carbon nanotube coupled to cellulose fibers via one of electrostatic charge and/or dipole, attraction.

4. The method of claim 1, where the liquid medium is water and the modified carbon nanotube develops an anionic or cationic surface character in the water to form the first adduct.

5. The method of claim 1, where the step of reacting the first adduct occurs after the step of removing the liquid medium.

6. The method of claim 1, where the step of removing the liquid medium includes heating the liquid medium and the paper compound with process heat, and the step of reacting the first adduct includes chemically bonding the first adduct to the paper compound with the process heat.

7. The method of claim 1, where the modified carbon nanotube is chemically bound to the paper compound by one of covalent, ionic and hydrogen bonding.

8. The method of claim 1, where the first binding moiety is selected from the group consisting of epoxy, amine, ammonium, hydroxyl, carboxylate and carboxylic acid.

9. The method of claim 1, where the paper-forming compound includes a cellulose-containing compound and the modified carbon nanotube is retained with the cellulose-containing compound to form the first adduct.

10. The method of claim 1, where the paper-treatment compound includes additives selected from the group consisting of an internal sizing agent, a surface sizing agent, a wet strength additive, a dry strength additive, a retention aide and drainage agent.

11. The method of claim 1, where the step of removing the liquid medium includes filtering the paper compound and the first adduct to form a filtrate, and pressing the filtrate to form a green stock composition, and where the step of reacting the first adduct includes hot pressing the green stock composition to form the loudspeaker cone.

12. A method of forming a loudspeaker cone comprising:

contacting paper-forming compound including cellulose with a liquid medium and agitating to produce a thick stock;

contacting in the liquid medium a modified carbon nanotube that includes a first binding moiety with the thick stock and a paper-treatment compound that includes a retention aide in a manner effective to retain the modified carbon nanotube with the cellulose to form a first adduct;

adding additional paper-treatment compound including functional and control additives to form a final papermaking furnish, the paper-forming compound and the paper treatment together forming a paper compound;

diluting the final papermaking furnish with additional liquid medium to form a thin stock;

depositing the thin stock onto a filtering medium;

progressively removing the liquid medium from the thin stock to produce a wet paper compound; and forming the loudspeaker cone including:

applying heat to the wet paper compound to remove residual liquid medium from the paper compound and the first adduct; and reacting the first binding moiety and the paper compound in a manner effective to chemically bound the modified carbon nanotube to the paper compound.

13. The method of claim 12, where the first adduct includes the modified carbon nanotube coupled to the cellulose via one of electrostatic charge and dipole attraction.

14. The method of claim 12, where the liquid medium is water and the modified carbon nanotube develops one of an anionic and cationic surface character when in water to form the first adduct.

15. The method of claim 12, where the step of reacting the first binding moiety occurs after the step of removing the liquid medium.

16. The method of claim 12, where the step of removing the liquid medium includes heating the liquid medium and the paper compound with process heat, and the step of reacting the first binding moiety includes chemically bonding the first adduct to the paper compound with the process heat.

17. The method of claim 12, where the modified carbon nanotube is chemically bound to the paper compound by one of covalent, ionic and hydrogen bonding.

18. The method of claim 12, where the step of adding paper-treatment compound is subsequent to the step of contacting the paper-forming compound.

* * * * *